US009581400B2

(12) United States Patent
Dove

(10) Patent No.: US 9,581,400 B2
(45) Date of Patent: Feb. 28, 2017

(54) APPARATUS FOR LOADING ROUNDS FROM MAGAZINES BUNDLED ON A MULTI-MAGAZINE MANIFOLD

(71) Applicant: Jason L. Dove, Huntersville, NC (US)

(72) Inventor: Jason L. Dove, Huntersville, NC (US)

( * ) Notice: Subject to any disclaimer, the term of this patent is extended or adjusted under 35 U.S.C. 154(b) by 33 days.

(21) Appl. No.: 14/695,758

(22) Filed: Apr. 24, 2015

(65) Prior Publication Data

US 2016/0313078 A1 Oct. 27, 2016

(51) Int. Cl.
*F41A 9/01* (2006.01)
*F41A 9/68* (2006.01)

(52) U.S. Cl.
CPC . *F41A 9/01* (2013.01); *F41A 9/68* (2013.01)

(58) Field of Classification Search
CPC ..... F41A 9/01; F41A 9/68; F41C 27/00
USPC ..... D22/108
See application file for complete search history.

(56) References Cited

U.S. PATENT DOCUMENTS 2,147,208 A * 2/1939 Nolan ..... F41A 9/68 42/49.01
D375,778 S * 11/1996 Hasselbusch ..... D22/108
7,975,420 B2 * 7/2011 Pestana ..... F41A 9/63 224/931
8,640,374 B1 * 2/2014 Reichelt ..... F41C 27/00 42/106
8,739,451 B2 6/2014 Nelson
9,097,477 B1 * 8/2015 Mead ..... F41A 9/26
9,175,923 B2 * 11/2015 Ruby ..... F41C 27/00
2011/0107645 A1 5/2011 Faifer

FOREIGN PATENT DOCUMENTS

FR 1002098 A * 3/1952 ..... F41A 9/04

OTHER PUBLICATIONS www.fab-defense.com/en/category-magazines-and-accessories/id-14178/ultimag-10r-pentagon-magazine-kit.html Described as a pentagonal magazine coupler. No other info available. Address: FAB Ltd.

* cited by examiner

*Primary Examiner* — Stephen M Johnson
*Assistant Examiner* — Joshua Semick
(74) *Attorney, Agent, or Firm* — F. Rhett Brockington

(57) ABSTRACT

The invention is an apparatus that facilitates repeatedly aligning and loading a magazine into a magazine-well of a firearm, where the firearm is a barreled weapon, including replicas, novelty firearms, mock firearms, gaming firearms such as paint ball guns, computerized guns, toys guns, pressurized gas propelled guns, and virtual guns that are digital representation. The apparatus includes multi-magazine manifold which can hold a plurality of magazines (clips), where the multi-magazine manifold is mounted to one or more vertical slides that automatically align a magazine with the magazine well. Ejection and reloading is faster and easier, and can be done without visually disengaging from a target because alignment is substantially established by the apparatus. The apparatus is rugged and simple to use, and can be fitted to wide variety of firearms.

9 Claims, 23 Drawing Sheets

APPARATUS FOR LOADING ROUNDS FROM MAGAZINES BUNDLED ON A MULTI-MAGAZINE MANIFOLD

BACKGROUND OF THE INVENTION

Field of the Invention

The invention relates generally to apparatus for loading magazine fed firearms with ammunition, and more particularly to an apparatus that facilitates loading rounds from a magazine from a plurality of magazines bundled by a multi-magazine manifold, where in the invented apparatus facilitates easier change from one magazine to a next magazine without taking eyesight off of a target.

Background

Magazines for firearms having a magazine well, as exemplified by the AR-15, vary in size depending on the application. In general military AR rifles typically would hold from about 30 rounds of ammunition up to about to about 100 rounds, depending on the caliber. Normally, the rounds are held in a single removable magazine that is secured in the magazine-well of the receiver. A magazine above about 60 rounds becomes very long and weighty, and the magazine is difficult to be effectively manned by most personnel. If the caliber is 45 or higher, the count can be lower, and the ammunition is instead often fed on a belt or mechanically automated. Civilian AR rifles tend to be limited to smaller magazines, typically holding from 5 to 30 rounds. Legislation in multiple states limits the round count to 10 rounds per magazine.

In the current specification, the term "magazine" is used throughout the specification to be inclusive of the term "clip" and other terms for prepackaged ammunition for firearms. The term "firearm" is used throughout the specification to be inclusive of a barreled weapon, including replicas, novelty firearms, mock firearms, gaming firearms such as paint ball guns, computerized guns, toys guns, pressurized gas propelled guns, and virtual guns that are digital representations.

A problem with a low round count and an automatic firearm, as exemplified by an AR-15, AR-16, Uzi and AK-47, is that with a short burst of fire the entire magazine can be emptied, and as the firearm fires the recoil tends to lift the barrel, especially if the magazine has a small round count. The recoil must be physically countered by the shooter, and can be actually harder to control than a firearm loaded with a larger heavier magazine, because the weight of the magazine helps to offset the recoil. To be armed, the shooter has to replace an emptied magazine with another magazine that contains rounds of ammunition, and the shooter's capability of aligning the magazine with the magazine-well is more difficult as the shooter becomes tired. The magazine-well is approximately rectangular, with a closed front side, a closed back side, an open bottom side and a top side that feeds to the firearm's chamber. The current prior art teaches that magazines can be coupled into groups, not unlike packaging, where the magazines are stacked and sometimes spaced. The prior art is silent on how coupled magazines can be utilized with an apparatus that facilitates their usage.

SUMMARY OF THE INVENTION

The invented apparatus makes it much easier to align and chamber a magazine in the magazine-well, so that changing magazines can be performed without visually disengaging from a target, wherein the magazine is one of a plurality of magazines bundled on a multi-magazine manifold, wherein the multi-magazine manifold can rotate and or can be shifted. An aspect of the invention is that the apparatus includes an adapter that is mounted onto a handguard, where the mount can be directly mounted to the handguard, or fitted onto a handguard rail that is mounted to the handguard. Examples of handguard rails include Picatinny and Weaver rails.

The adapter is made of a durable material, as exemplified as an engineering plastic, a durable plastic, a suitable metal or metal alloy as exemplified by aluminum and steel. The adapter is securely affixed to the handguard rail, nominally to a lower portion of the receiver and forward of the magazine-well. In one variation the adapter includes a beam and fastening elements, as exemplified by one or more locking bolts with hardened steel hex head nuts. The adapter provides a solid platform that won't slip even under heavy recoil.

Another aspect of the invention is that nominally the multi-magazine manifold is a symmetrical device that has a plurality of mounting faces on a side of one or more polygons, wherein a base of a magazine can be secured to a mounting face on the side of the polygon and the base of another magazine can be secured to an adjacent side or an opposing side, the exact configuration being dependent on the size, shape and number of the polygons.

Another aspect of the invention is that the apparatus includes one or more slide rails in connection with the adapter, where at least one slide rail is a vertical slide rail, and the vertical slide rail has a slidable element with a strut assembly that extends rearward toward the magazine well and provides a supporting connection to the multi-magazine manifold. A position of the strut assembly is determinative as to when the multi-magazine manifold, loaded with magazines, can be changed. When the position of the strut assembly is in a magazine is loaded into the magazine well of the firearm, then the multi-magazine manifold is stationary until released, causing the magazine to be ejected. When the position of the strut assembly is out, the multi-magazine manifold can be rotated and or shifted to a next stopping point where a next magazine is aligned beneath the magazine well. Nominally, the orientation of a firearm being fired is upright, and when a magazine is ejected gravity helps move the magazine, the manifold and other movable elements of the invention downward.

The strut assembly provides spatial orientation for a magazine to be withdrawn or inserted in the magazine-well, wherein the strut assembly, mounted on a slidable element moves downward when a loaded magazine is ejected from the magazine-well. The strut assembly is nominally raised to insert a next magazine in the magazine-well.

While in the out position the multi-magazine manifold can be rotated and/or shifted to a predetermined stop, where the next magazine is stopped in spatial alignment with the magazine-well, where the ammunition of the next magazine is properly oriented to be chambered when the next magazine is loaded into the magazine-well.

Another aspect of the invention is that rotation is either in a plane of a side view of the firearm, or rotation is into the page of a side view of the firearm, or rotation is not required. The orientation of the rotation is largely dependent on the configuration the multi-magazine manifold.

Another further aspect of the apparatus is that it can include a horizontal slide rail, wherein the horizontal slide rail is mounted at right angles to the adapter. The horizontal slide rail includes a horizontal slidable element having a rigidly attached vertical slide rail assembly, where the vertical slide rail assembly can include piggy backed vertical rails wherein a second vertical slide rail is coupled to a first vertical slide rail with one or more slidable elements. Movement of the horizontal slidable element and the affixed vertical slide rail assembly is in the z plane, which is into or out-of the page of the side view of the apparatus mounted on a firearm.

Nominally, the horizontal slide rail has two or more z-plane stopping points for shifting the horizontal slidable element. The z-plane stopping points are selected so that at least one of the magazines which is affixed to the multi-magazine manifold is spatially aligned between a right side and a left side of magazine-well. A length of one or more strut elements of the strut assembly is selected so it that extends rearward from the vertical slide rails where the next magazine to be loaded is spatially aligned front-to-back with the magazine-well. Loading does not require that a user visually disengage from a target, as alignment is automatic.

Another aspect of the invention is that the apparatus can include a slidable grip assembly that is attached to the adapter forward of the at least one vertical slide rail. A strong rod, one that can support recoil, extends downward. A hand grip having an annular slidable element, enabling the hand grip to slide over the strong rod. The hand grip is attached to a brace that is an L shaped bar having a horizontal section and a vertical section, wherein the horizontal section of the L shaped bar provides support for the hand grip and the vertical section provides support for at least one vertical slide element. The horizontal section of the L shaped bar has a foreword opening through which passes the strong rod, extending rearward, wherein the vertical section overlaps at least one vertical slide rail.

In one variation, when the magazine release button on the firearm is pressed, the magazine is ejected, therein allowing the hand grip to drop to a lowered position. Similarly, the other vertical slidable components and the multi-magazine manifold all move downward when the magazine is ejected from the magazine well.

Another aspect of the apparatus is that it can include an automatic rotation mechanism to advance the multi-magazine manifold to the next magazine. The automatic rotation mechanism utilizes energy released when an empty magazine is ejected to rotate the multi-magazine manifold to the next magazine.

The apparatus can include a quick connect mechanism for attaching the multi-magazine manifold to the strut assembly.

BRIEF DESCRIPTION OF THE DRAWINGS

The foregoing invention will become readily apparent by referring to the following detailed description and the appended drawings in which:

FIG. 1*a* Illustrates the apparatus with a first vertical slide rail projecting downward from an adapter mounted to the handguard rail, a first slidable element with a strut assembly extending from the first slidable element to a semi-rotatable multi-magazine manifold, wherein a magazine designated "O", which is attached to a face of the multi-magazine manifold, is inserted in the magazine-well and a magazine designated "X" is on the opposing face of the multi-magazine manifold;

FIG. 1*b* illustrates the apparatus wherein the "O" magazine has been ejected from the magazine-well, and the "O" magazine has dropped a distance sufficient to clear a rim of the magazine-well, the movement of the "O" magazine has caused the slidable element to slide to a vertical slide stop, which prevents further drop of the "O" magazine;

FIG. 1*c* illustrates the apparatus wherein the multi-magazine manifold is rotating in a plane of a side view of the firearm;

FIG. 1*d* Illustrates the apparatus wherein the semi-rotatable multi-magazine manifold has been flipped, aligning the "X" magazine with the magazine-well and, and the "X" magazine has been pushed upward into the magazine-well, wherein the rounds can be chambered and the slidable element has been returned to the raised position on the vertical slide rail;

FIG. 2*a*-2*d* are mechanistically similar to FIG. 1*a*-1*d* except that rotation of the rotatable multi-magazine manifold is into the page of a side view of the firearm;

DETAILED DESCRIPTION OF THE INVENTION

Figure 1A:
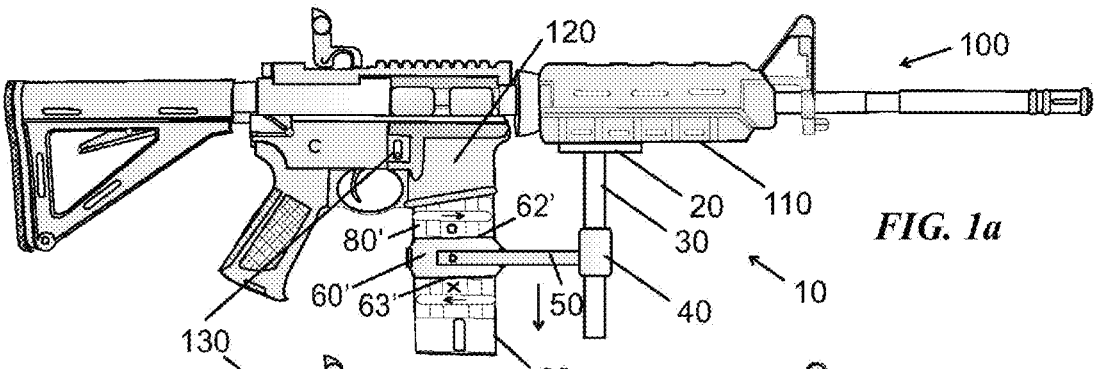
FIG. 1*a*-FIG. 1*d* and FIG. 2*a*-FIG. 2*d* are a series of conceptual side views of a firearm, which in the illustration is an AR rifle, that is fitted with the invented apparatus, where the apparatus is mounted to the firearm's handguard rail, forward of the firearm's magazine-well, therein providing a facile apparatus for loading rounds from magazines bundled on a rotatable multi-magazine manifold, a shiftable semi-rotatable multi-magazine manifold or a shiftable multi-magazine manifold, wherein the difference between a semi-rotatable manifold and rotatable manifold, as shown in the drawings, is that the rotatable manifold can rotate 360 degrees through a plane that is orthogonal to the page of the side-view of the firearm, while the semi-rotatable manifold can be flipped through 180 degrees co-planar to the page. Manifolds that are shiftable can be moved in and out-of planes that are co-planar with the page (not shown). In the concept drawings the multi-magazine manifolds have only two magazines to simplify the figure.

The invention is an apparatus that facilitates repeatedly aligning and loading a magazine into a magazine-well of a firearm, without the need for to visually disengage from a target. The apparatus includes a multi-magazine manifold which can hold a plurality of magazines, where the multi-magazine manifold is mounted to one or more vertical slides that with minimal assistance align a magazine with the magazine well. Ejection and reloading is faster and easier, as alignment is substantially built into the apparatus. The apparatus is rugged and simple to use, and can be fitted to a wide range of firearms.

The apparatus is conceptually illustrated in FIG. 1*a*-FIG. 1*d* and FIG. 2*a*-FIG. 2*d*, which are a series of side views of a firearm 100 fitted with the apparatus 10. The apparatus 10 is forward of the firearm's magazine-well 120 and mounted to the handguard rail 110. The firearm has a magazine ejection device 130 that releases magazines, causing them to be ejected from magazine-well. The apparatus provides a facile mechanism for repeatedly loading rounds from magazines 80,80' bundled on a rotatable multi-magazine manifold 60 or on a semi-rotatable multi-magazine manifold 60', and also a non-rotatable clamped multi-magazine manifold (not shown conceptually).

In the apparatus FIG. 1*a*-FIG. 1*d* the apparatus 10 has a semi-rotatable multi-magazine manifold 60'. The first vertical slide rail 30 extends downward from the adapter 20. The first vertical slide rail 30 is mounted to the handguard utilizing a handguard rail 110. The first vertical slide rail 30 has a first slidable element 40 with a strut assembly 50 extending from the first slidable element 40 to the semi-rotatable multi-magazine manifold 60', wherein the magazine 80', designated "O", is attached to a side with a face 62' of the semi-rotatable multi-magazine manifold 60', and the "O" magazine is inserted in the magazine-well 120 of the firearm 100 and a magazine designated "X" is on the opposing side with a face 63' of the semi-rotatable multi-magazine manifold 60'.

Figure 1B:
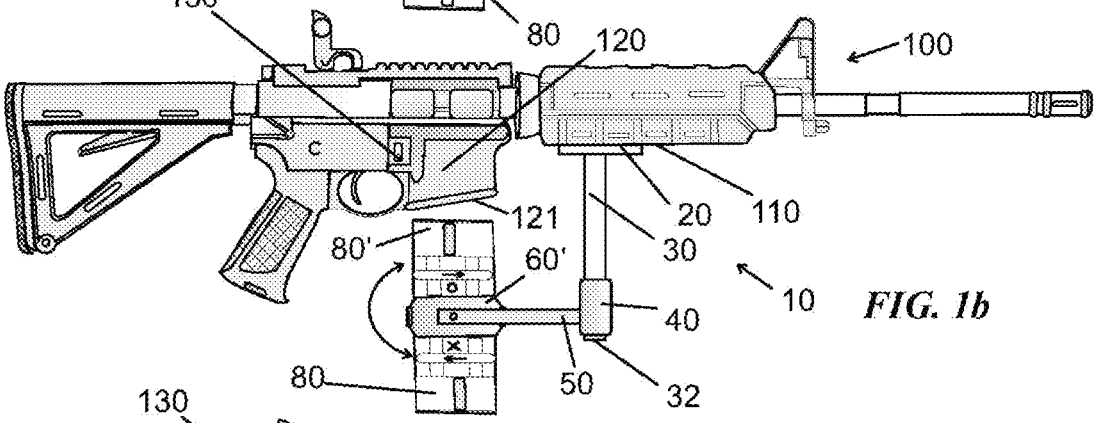
Figure 1C:
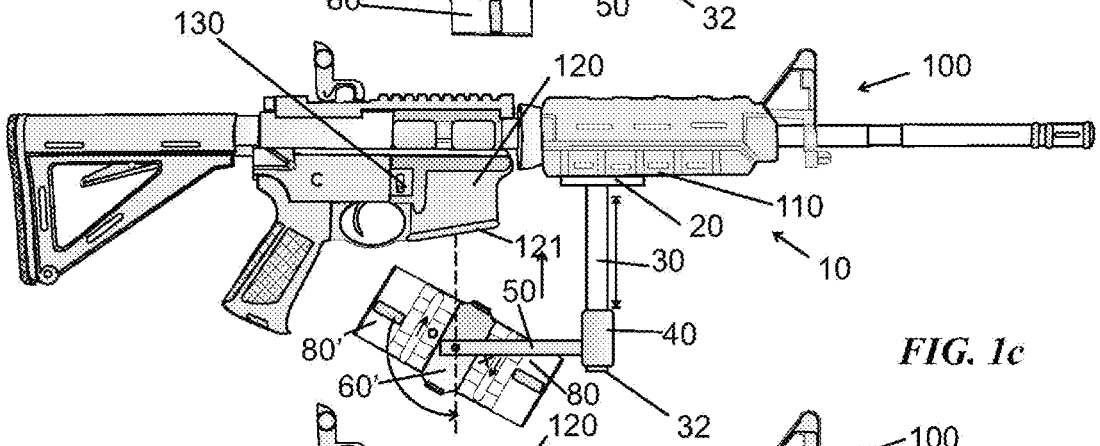
Figure 1D:
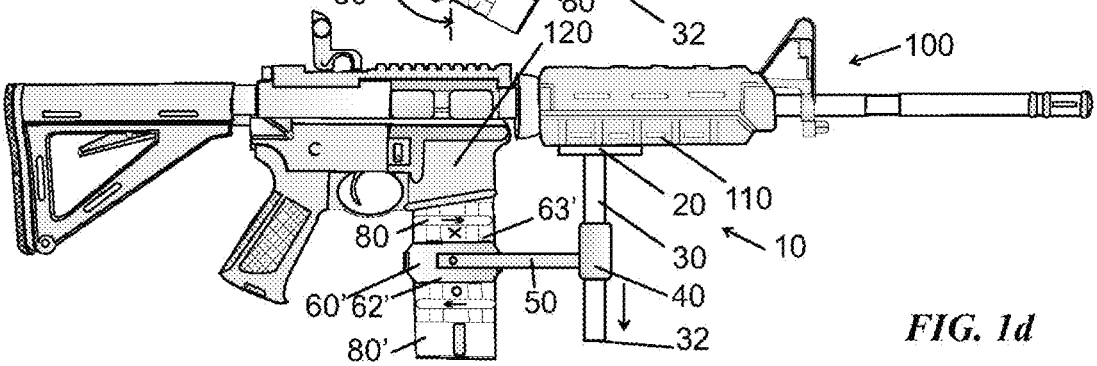
Figure 2A:
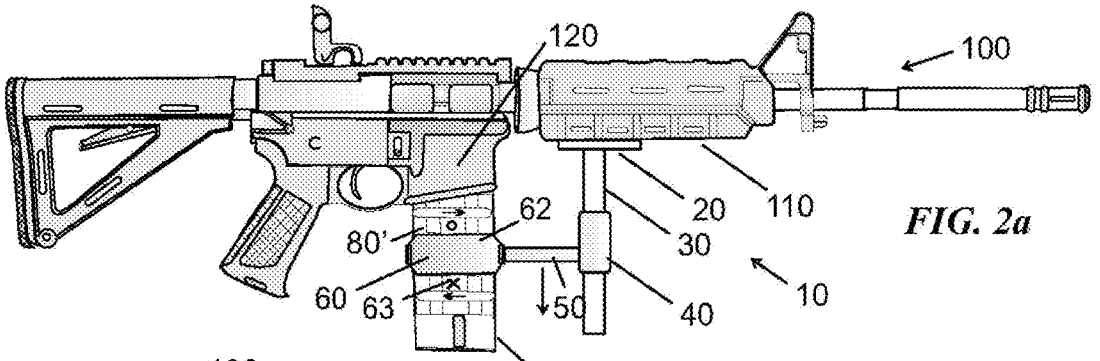
Figure 2B:
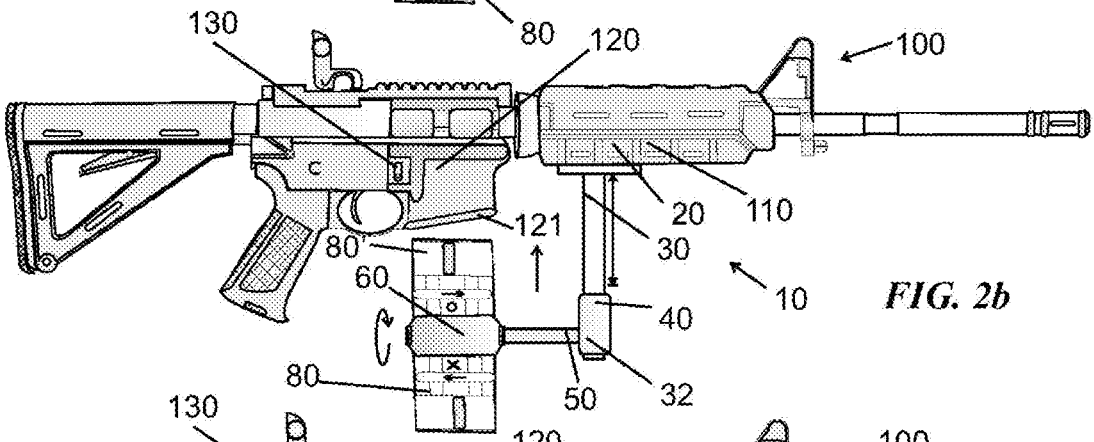
Figure 2C:
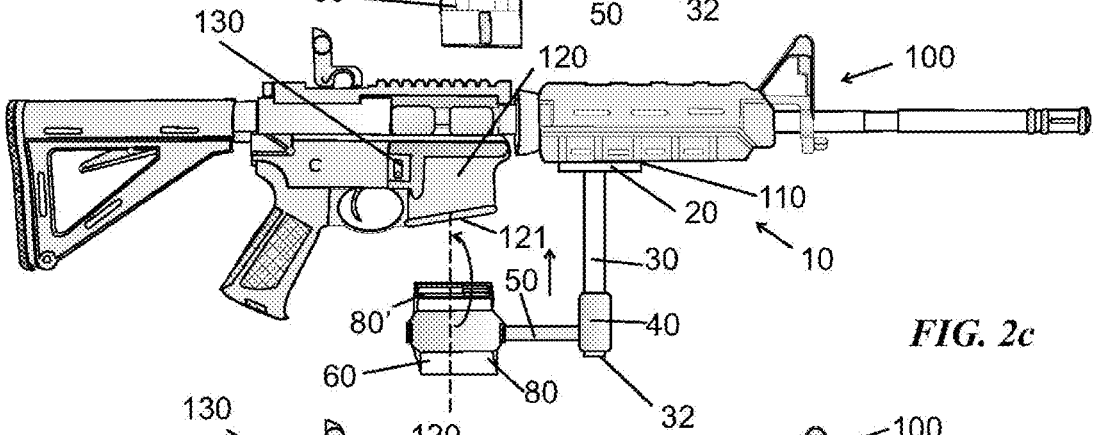
Figure 2D:
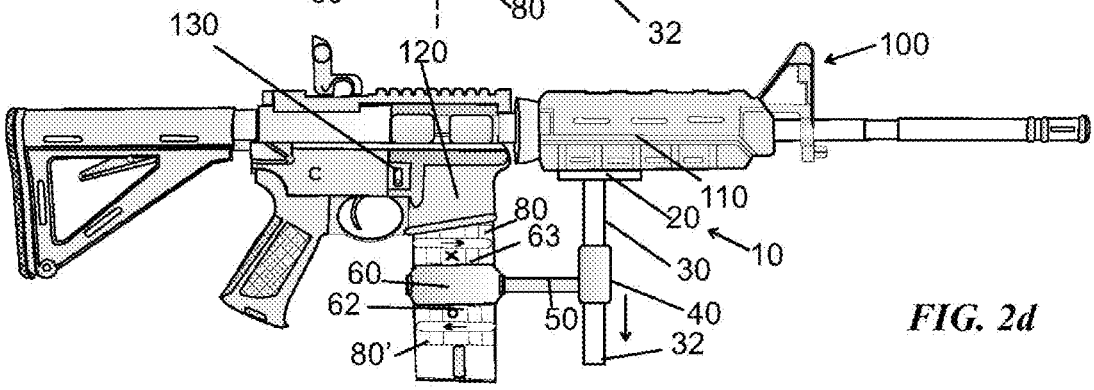

In FIG. 1*b* the "O" magazine has been ejected from the magazine-well, and the "O" magazine 80' has dropped a distance sufficient to clear a rim 121 of the magazine-well 120, the movement of the "O" magazine has caused the first slidable element 40 to slide to a vertical slide full-stop element 32, which prevents further drop of the "O" magazine;

The semi-rotatable multi-magazine manifold 60', as shown in FIG. 1*c*, has turned about 45 degrees of the 180 degrees necessary to flip to the next magazine 80, which is distinguished by the "X". The semi-rotatable multi-magazine manifold 60' has been flipped, as shown in FIG. 1*d*, therein aligning the "X" magazine 80 with the magazine-well 120 and, and the "X" magazine 80 has been pushed upward into the magazine-well 120, wherein the rounds can be chambered and the first vertical slidable element 40, the strut assembly 50 and the semi-rotatable multi-magazine manifold 60' are back to the raised position on the first vertical slide rail 30.

The apparatus 10 with the rotatable multi-magazine manifold is shown in FIG. 2*a*-2*d*. The action is mechanistically similar to FIG. 1*a*-1*d* except that rotation of the rotatable multi-magazine manifold 60 is into the page of a side view of the firearm 100. The mounting faces are numbered 62 and 63, dropping the apostrophe, indicating that the manifold is rotatable.

The rotatable multi-magazine manifold is a polygon having an axial center and having perimeter walls with magazine mounting faces, wherein a magazine mounting face can receive and hold a magazine utilizing a bottom end portion of the magazine, wherein each of the mounting faces can be fitted with one magazine.

Figure 3:
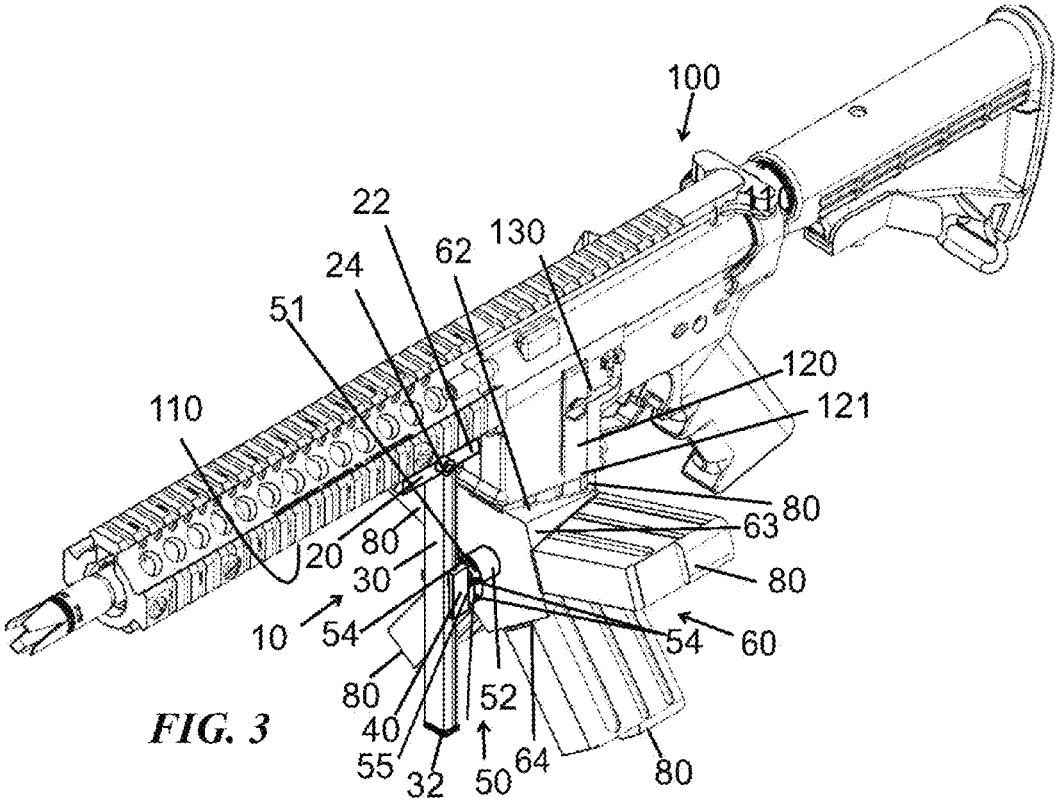
FIG. 3 is an elevated perspective view of the apparatus mounted on a firearm having a handguard fitted with a Picatinny—Weaver-style rail, where the rotatable multi-magazine manifold is a polygonal frustrum having a plurality of planar sides that are tapered, where each tapered side provides a mounting face that can receive a standard issue magazine which nominally has an angled base and an atypical magazine that has a non-angled base.
Figure 11:
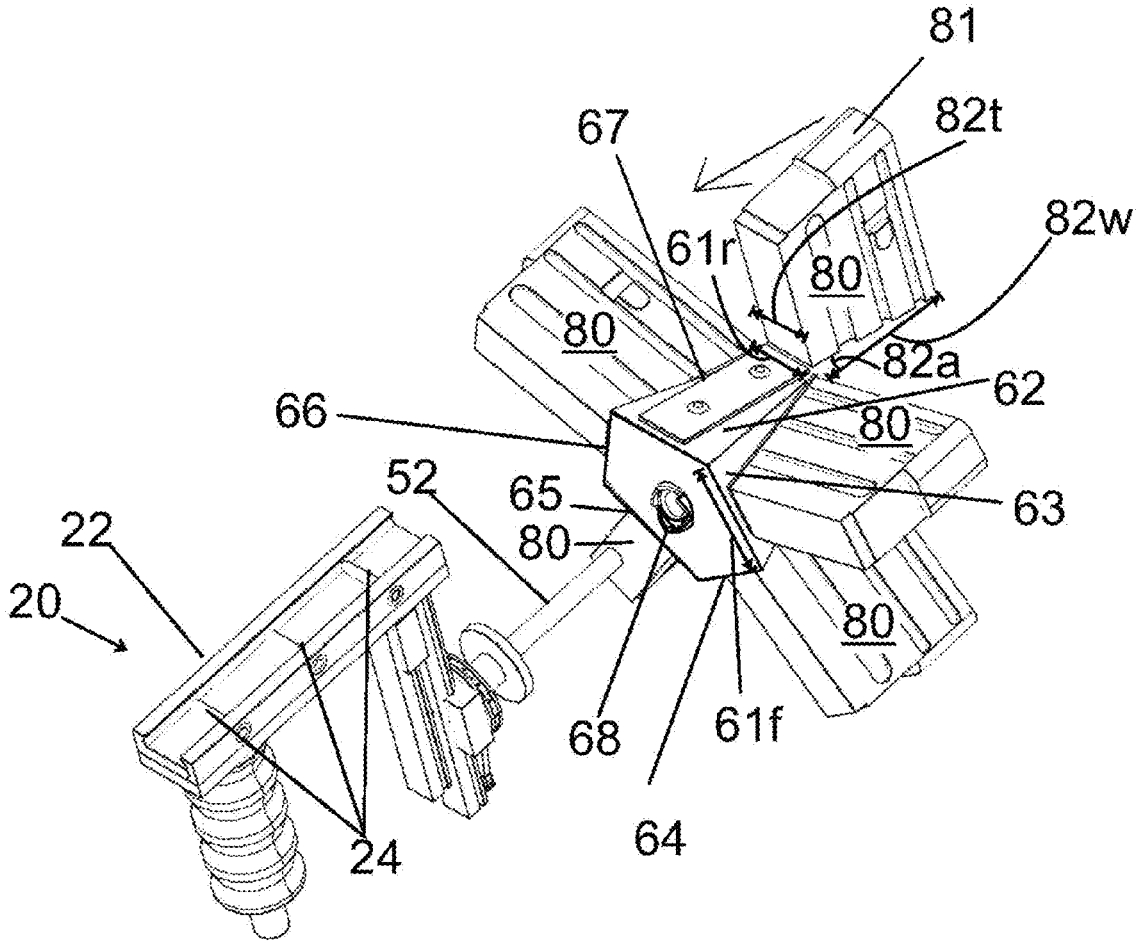
FIG. 11 is an elevated partially exploded view of the apparatus having a slidable grip assembly, wherein a standard 10 round magazine having an angled base is being loaded onto a mounting face of the rotatable multi-magazine manifold which is pentagonal polygonal frustum in shape, and the rotatable multi-magazine manifold is being fitted to the strut assembly of the apparatus, wherein the apparatus has an automatic rotation mechanism mounted on the second slidable element that slides on the second vertical slide rail, wherein when the magazine is ejected from a magazine well the first vertical slidable element starts moving toward a lowered position before the second vertical slidable element causing a delayed action of the automatic rotation mechanism, as shown in FIG. 10, in part because the geared cocking round lever on the second vertical slidable element is above the latch on the second vertical slide rail, and additionally the second vertical slidable element can be partially restrained by an indent until the first vertical slidable element is stopped at its lowest position.

In most cases it is anticipated that the apparatus will be used to align and load more than one magazine, and FIG. 3 illustrates an embodiment where the rotatable multi-magazine manifold 60 has five magazines. The illustrated rotatable multi-magazine manifold 60 is a pentagonal frustum polygon (a.k.a a polygonal frustum). Portions of the mounting faces 62,63,64 are visible in this perspective view. The two faces 65,66 not shown in FIG. 3 are shown in FIG. 11. The magazine-well 120 of the firearm 100 currently is filled with a magazine.

FIGS. 12*a*, 12*b* 12*c* and 12*d* illustrate several other, but not all, possible embodiments of rotatable multi-magazine manifolds that are similar suitable polygons. The polygons have an axial center and a plurality of perimeter walls, wherein the perimeter walls have external mounting faces. An external mounting face can receive and hold a magazine by a base portion of the magazine in potential alignment with the magazine-well, and when the manifold is filled the magazines are in radial alignment with the axial center.

Standard magazines nominally have an angled base to accommodate for the shape of the ammunition, and the illustrated polygonal frustums are similarly tapered to accommodate for the angle of the base of the magazine. For magazines having a substantially non-angled base, the polygon can be modified or selected to mount magazines with non-angled bases (not shown). Each rearward edge 61*r* of the frustum must have a length that is at least as long as a thickness 82*t* of a magazine, and each forward edge 61*f* frustum must be long enough that the taper matches the angled base 82*a* of the magazine, and also long enough to accommodate a width 82*w* of the magazine (see FIG. 11).

Each of the frustums illustrated in FIGS. 12*a*, 12*b* 12*c* and 12*d* is symmetrical, so that all faces on a given frustum are the same. The dimensions of the base and shape of a standard issue magazine was used to determine the size and shape of the manifold. The illustrated frustums are uniquely suitable for providing a multi-faced manifold. The practical range for a rotating manifold is up to six sides, as the frustum becomes overly large and once installed with loaded magazines, would be overly weighty above this for typical firearms.

Returning to FIG. 3, the adapter 20 includes a beam 22 with a set of fastening elements 24. The adapter provides an ultra-solid platform that won't slip even under heavy recoil, wherein the adapter is mounted to the handguard rail 110 forward of the magazine-well 120. The handguard rail is exemplified by a Picatinny and Weaver-style rails. The magazine ejection device 130 is nominally just rear of the magazine-well as shown in the illustrated embodiment. The first vertical slide rail 30 is a rigid structural member, wherein an upper end of the first vertical slide rail is mounted on the adapter 20 perpendicular to the beam 22. The lower opposing end is terminated with a full-stop element 32. The vertical slide rail functions as a guiding track to which a carriage can be secured. The first vertical slidable element 40 is supported and guided by the first vertical slide rail 30, wherein the first vertical slidable element 40 is gripping the first vertical slide rail 30 and functions as the carriage having a first resistance to moving along the first vertical slide rail 30 even when the first vertical slidable element is under stress, wherein the first vertical slidable element has a mountable surface that faces rearward toward the magazine-well 120.

The rotatable multi-magazine manifold 60 shown in FIG. 3 is a symmetrical polygonal frustum with an axial center 68 (see FIG. 11) and has five perimeter walls with magazine mounting faces 62,63,64,65,66. As shown in FIG. 11 the magazine mounting face can receive and hold a magazine utilizing a bottom end portion 82 of the magazine 80, wherein each of the mounting faces can be fitted with one magazine.

Figure 4:
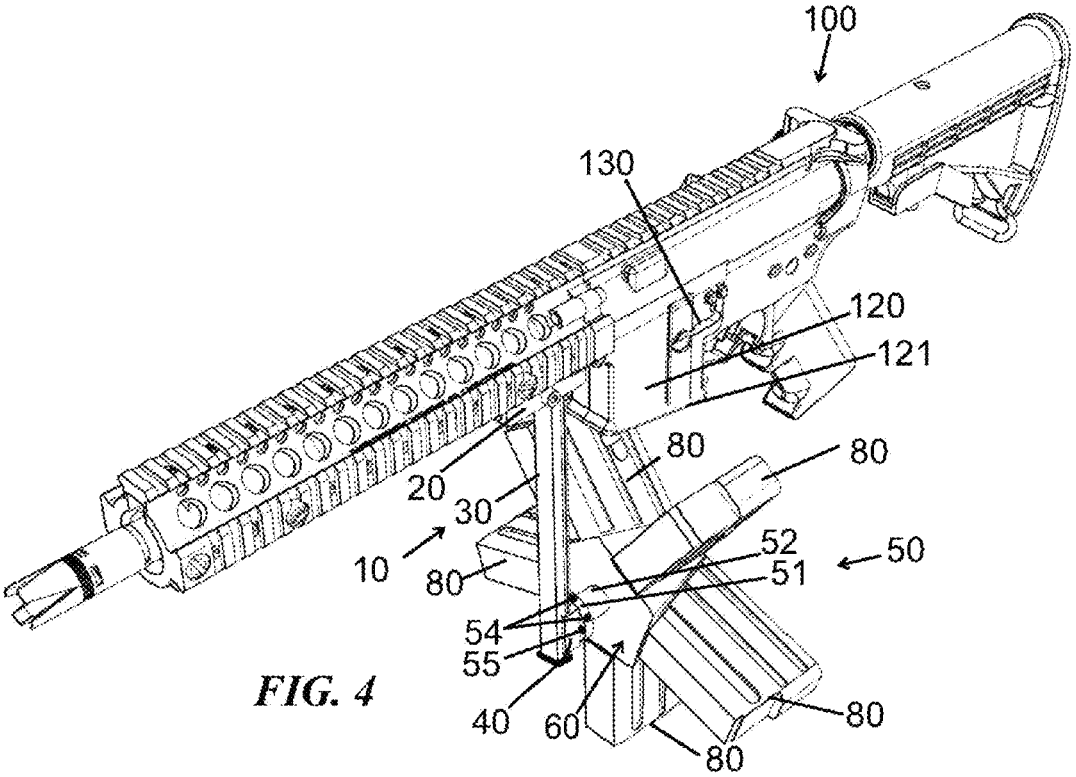
FIG. 4 is an elevated perspective view of the apparatus mounted on the firearm shown in FIG. 3, wherein a magazine that was previously loaded in the magazine-well has been ejected, and the rotatable multi-magazine manifold is rotating to the next magazine.

The rotatable strut assembly 50 has a strut 52, a positioning plate 51 with a plurality of set points 54 as shown in FIG. 3 and FIG. 4. In FIG. 3 a detent 55 can be seen that has a slightly protruding spring loaded ball (see FIG. 11*a*). The ball is aligned and partially seated in an opposing recess. In FIG. 4 the detent 55 is not aligned with any of the recesses 54 as the rotatable multi-magazine manifold is being rotated to the next magazine.

Figure 5:
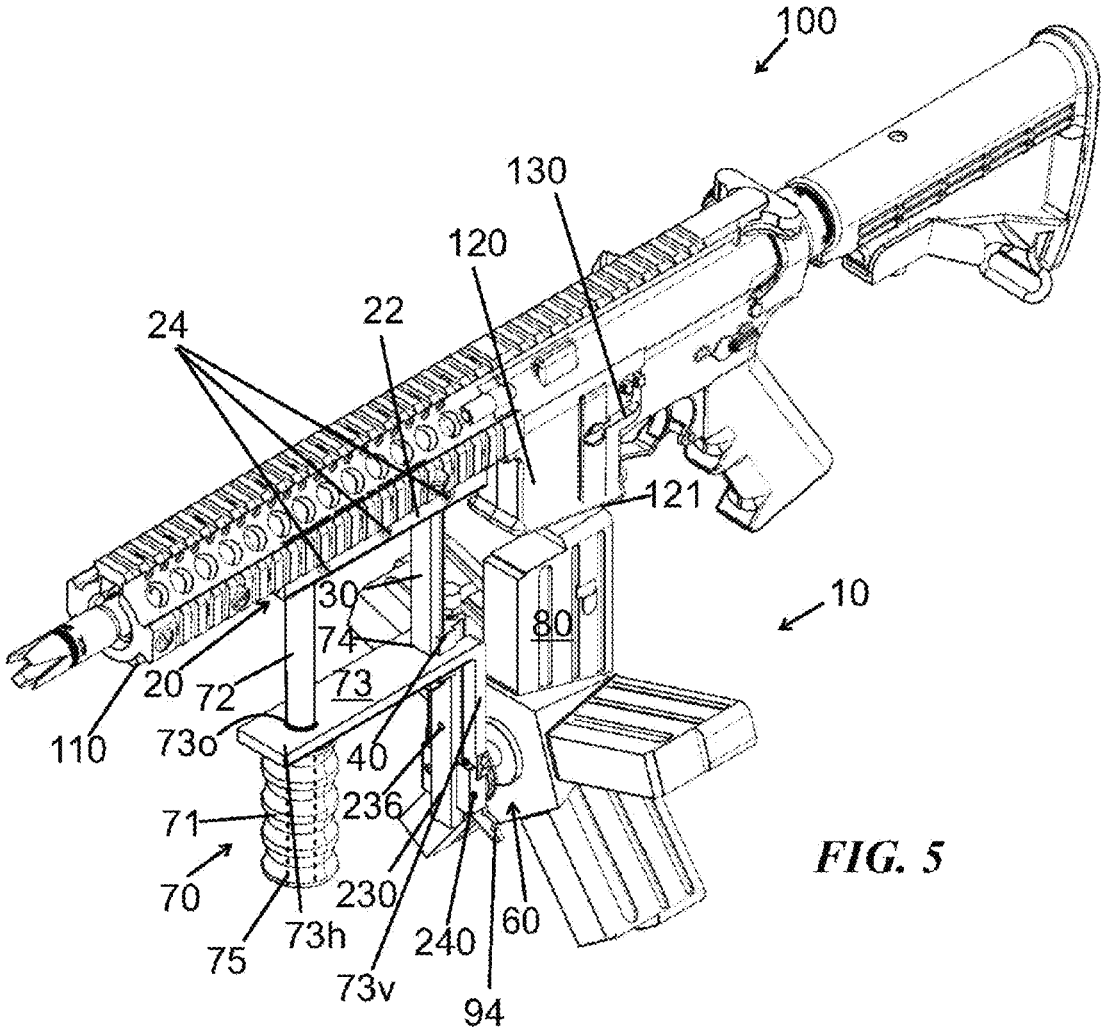
FIG. 5 is an elevated perspective view of the apparatus mounted on a firearm having multiple Picatinny—Weaver-style rails, wherein the apparatus includes a slidable grip assembly that is mounted to the adapter forward of the vertical slide rail, and the apparatus further includes an automatic rotation mechanism which angularly advances the rotatable multi-magazine manifold to the next magazine.
Figure 6:
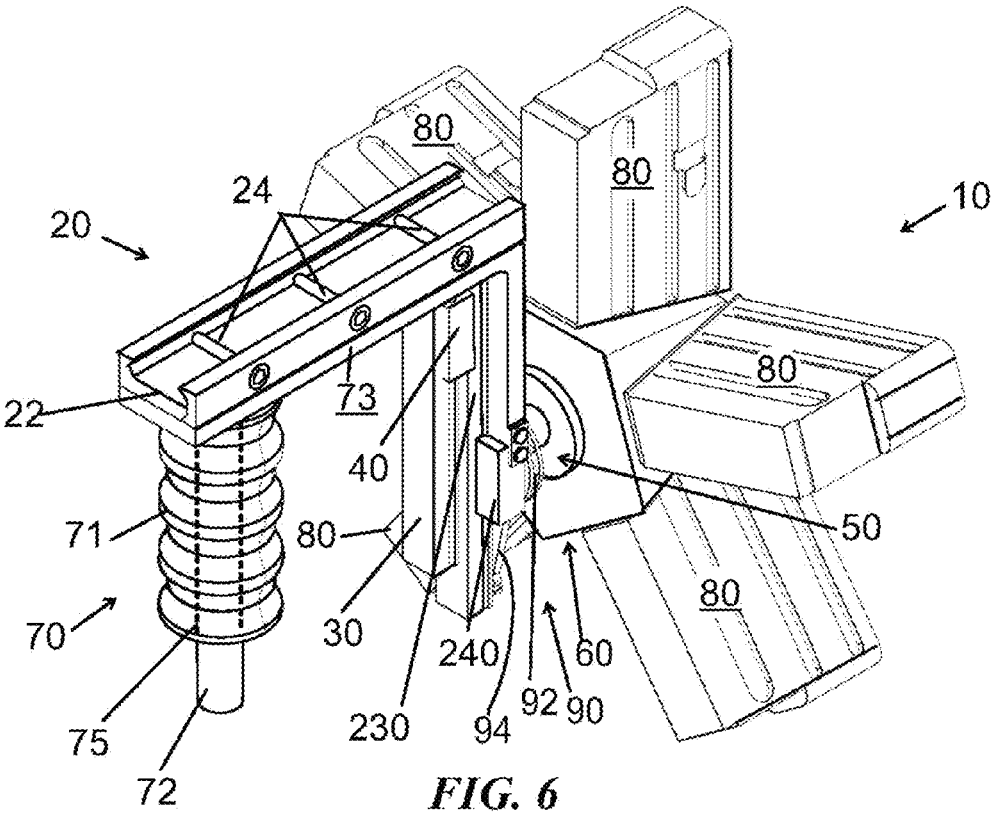
FIG. 6 is an enlarged elevated perspective view of the apparatus shown in FIG. 5 sans the firearm, wherein the apparatus is in the raised position.

The strut 52 has a length selected to align a front exterior magazine side inside of an interior front magazine-well wall, and the set point for each of the magazine mounting faces is selected so that both magazine exterior side walls are aligned to fit inside the magazine-well. When the magazine ejection device 130 is actuated, the magazine in the well 120 is ejected causing the manifold 60, the rotatable strut assembly 50 and the first vertical slidable element 40 all to drop to their lowest position. The multi-magazine manifold can be turned to a next set point for the next magazine, and the next magazine is now positioned beneath and in-line with an empty magazine-well, wherein the next magazine can be shoved into the empty well. FIG. 5 illustrates the position of the next magazine just prior to being shoved into the magazine-well 120. Raising the magazine raises the manifold 60, the rotatable strut assembly 50 and the first vertical slidable element 40 to their upper operational position.

The apparatus 10 shown in FIG. 5 also illustrates a slidable grip assembly 70 that is mounted to the adapter 20 forward of the first vertical slide rail 30. The slidable grip assembly 70 includes a strong rod 72 mounted to the adapter 20. The beam 22 of the adapter 20 is extended to accommodate the slidable grip assembly 70, and the adapter has additional fastening elements 24 to attach the slidable grip assembly 70 to the handguard rail 110. The strong rod 72, which can support recoil, extends downward from the adapter 20. The slidable grip assembly 70 includes a hand grip 71 having an annular element 75 (shown in ghost as dashed lines), wherein the hand grip can slide over the strong rod 72. The annular element 75 is a core grip slidable element, for example a nylon bearing or a tubular element or ball bearings. There is a brace, which is an L shaped bar 73 having a horizontal section 73*h* and a vertical section 73*v*, wherein the horizontal section 73*h* of the L shaped bar provides support for the hand grip and the vertical section 73*v* provides support for at least one vertical slide rail. The horizontal section 73*h* of the L shaped bar has a forward opening 73*o* through which passes the strong rod 72 and rearward opening 74 that can accommodate the first vertical slide rail 30, the first vertical slidable element 40, and the second vertical slide rail 230 as shown in FIG. 7.

The L shaped bar 73 extends rearward overlapping the second vertical slide rail 230 and is attached to the second vertical slidable element 240, therein indirectly providing support for the second vertical slide rail 230. FIGS. 5, 6, 7, 8 and 9 illustrate the overlap of the vertical section 73*v* of the second vertical rail 230.

The second vertical slide rail 230, which is a rigid structural member, is mounted on the first vertical slidable element 40, and so when extended it only partially overlaps the first vertical slide rail 30. The second vertical slide rail 230 functions as a retractable extension of the first vertical slide rail 30. The vertical section 73*v* supports the second vertical slide rail 230 even when it is fully extended. The first and second vertical slide rail can be terminated with a second full-stop element (not shown) to ensure that the first and second vertical slidable elements remain on their corresponding vertical slide rails.

Figure 7:
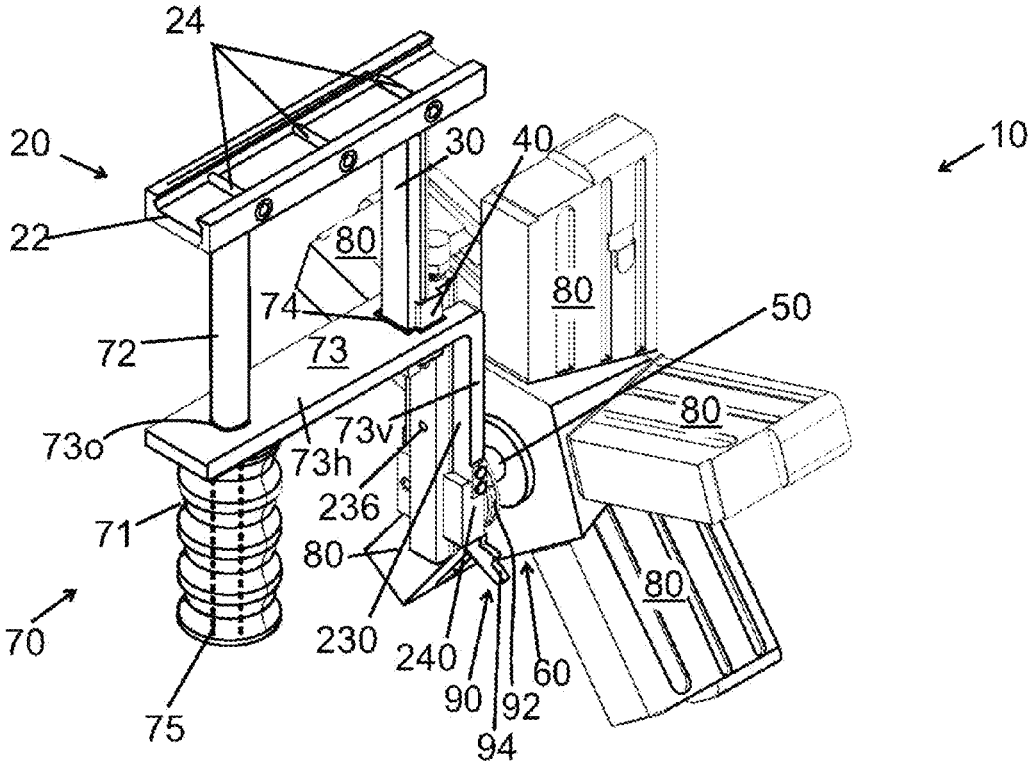
FIG. 7 is an enlarged elevated perspective view of the apparatus shown in FIG. 5 where the slidable grip assembly has a brace that is an L shaped bar with a horizontal section and a vertical section that overlaps a second vertical slide element that is piggy-backed on a first vertical slide rail, where the second vertical slide rail functions as an extension of the first vertical slide rail, wherein the vertical section of the L shaped bar is connected to a second slidable element, where the second slidable element has an automatic rotation mechanism connected to the strut assembly, and when a magazine is ejected the automatic rotation mechanism causes the rotatable multi-magazine manifold to rotate to an alignment position for loading the next magazine.
Figure 8:
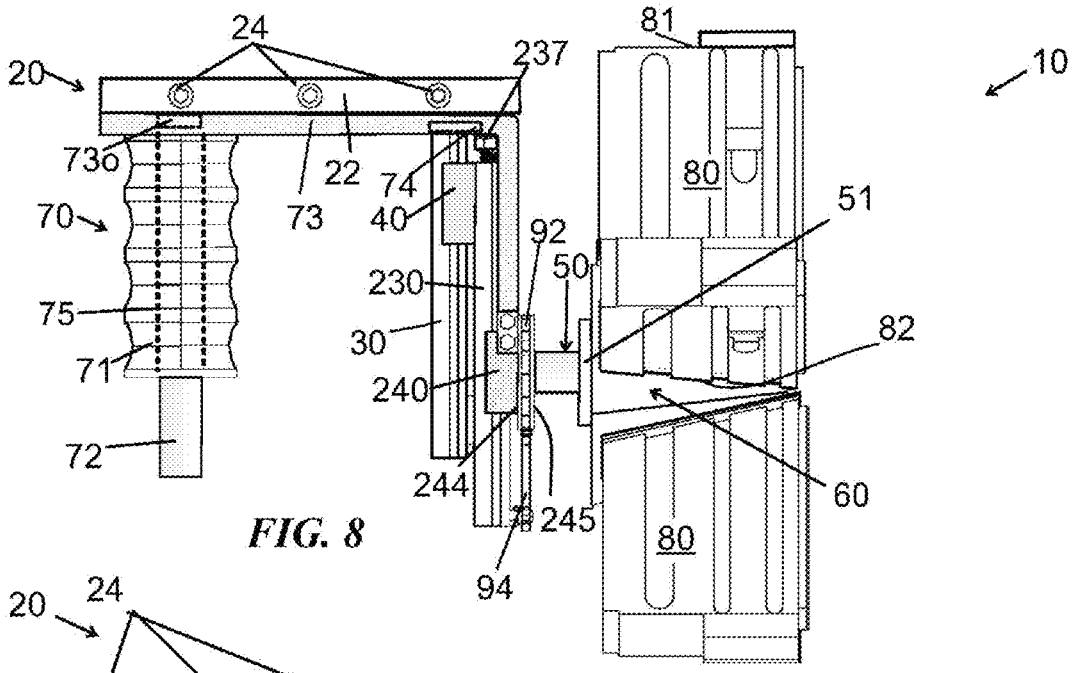
FIG. 8 is a side view of the apparatus shown in FIG. 6, where the rotatable multi-magazine manifold is raised and, as shown, an upper magazine would be in the magazine-well.
Figure 9:
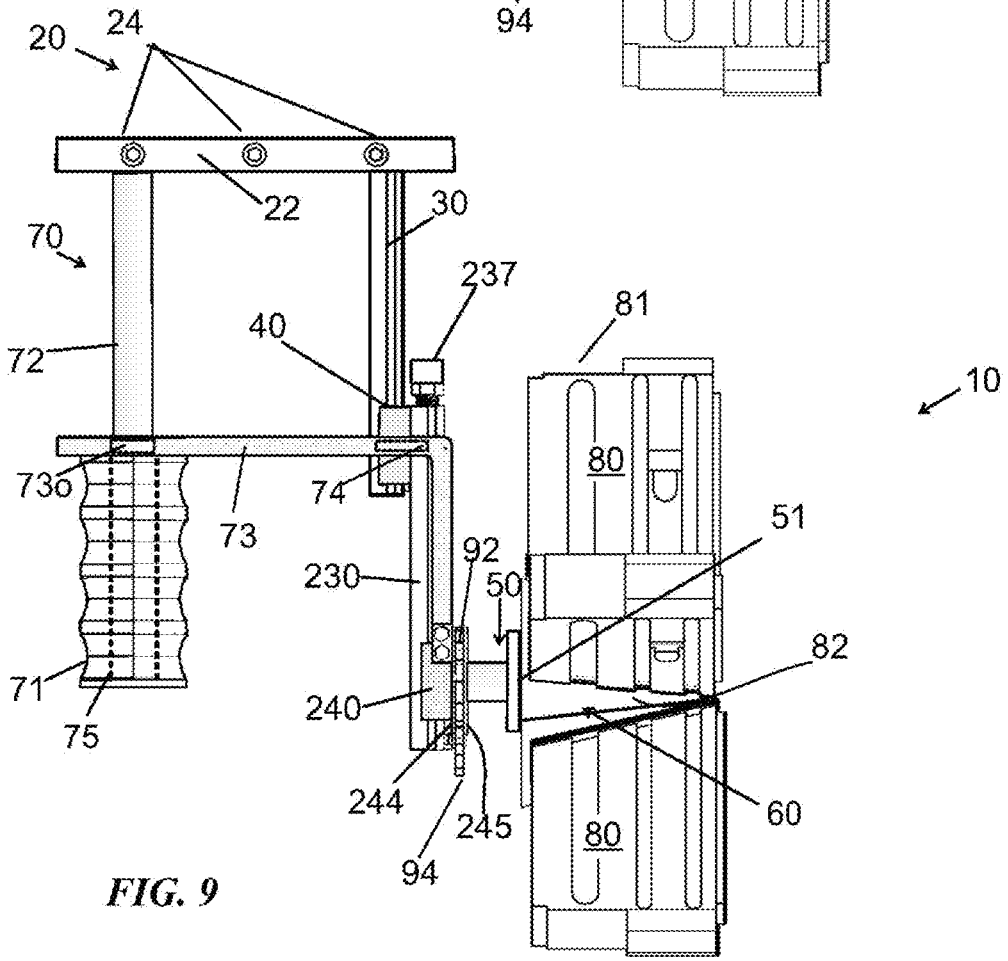
FIG. 9 is a side view of the apparatus shown in FIG. 6, where the rotatable multi-magazine manifold is lowered.

In FIG. 7 the illustrated apparatus 10, which has a second vertical slide rail 230, also has an adjustable resistance element 236 that is set to a second resistance that is higher than the first resistance, therein preventing the second vertical slidable 240 element from moving as fast as the first vertical slidable element 40 therein ensuring that rotation commences only after an ejected magazine has cleared the rim of the magazine-well This is particularly important when the apparatus 10 also has an automatic rotation mechanism 90 that advances the rotatable multi-magazine manifold 60 to the next magazine, as rotation should only commence after an ejected magazine has cleared the rim 121 of the magazine-well 120 as shown in FIG. 5. The automatic rotation mechanism 90, is only barely visible in FIG. 7 and FIG. 6, except for a latch 94 and a partial view of a geared cocking round lever 92. The side view in FIG. 8 and FIG. 9 provide more detail. The automatic rotation mechanism is described in greater detail below.

Recapping, the apparatus in FIG. 3 and FIG. 4 had only a single vertical slide rail 30. In FIG. 5, the addition of the grip assembly expanded the number of vertical slide rails to include a second vertical slide rail 230, where the second vertical slide rail is attached to the first vertical slide rail via first vertical slidable element 40. When there was one vertical slide rail (FIG. 3 and FIG. 4) the strut assembly 50 was mounted on the first vertical slidable element 40. When there is a second vertical slide rail 230, the strut assembly 50 is mounted on a second vertical slidable element 240. In FIG. 6, FIG. 7, FIG. 8, and FIG. 9 illustrate more detail about the apparatus, as the apparatus is not mounted, and further expand on the elements of the automatic rotation mechanism.

The apparatus is illustrated in FIG. 8 in the raised ready position, and in FIG. 9 in the lowered, rotatable position. In the raised position the upright magazine 80 normally is in the magazine-well. In the illustrated embodiment the apparatus 10 includes a slidable grip assembly 70 mounted to the adapter 20 forward of the first vertical slide rail 30. A strong rod 72 extends vertically downward from the adapter 20. The fastening elements 24 attach the beam 22 of the adapter 20 to a handguard rail 110 (FIG. 5). Three bolts and nuts are shown for securing the adapter 20 to the to the handguard rail. The slidable grip assembly 70 and the first vertical rail 30 are structurally secured to an underside of the beam 22. The L shaped bar 73 is a strength element and is vertically slidable. The brace, an L shaped bar has a horizontal section 73*h* and a vertical section 73*v*, wherein the horizontal section 73*h* of the L shaped bar provides support for the hand grip and the vertical section 73*v* provides support for at least one vertical slide rail. The annular element 75 provides the grip with a hollow core enabling both the grip and the horizontal section 73*h* it is attached to move vertically. As shown in FIG. 7, the forward opening 73*o* can slide over the strong rod 72 and the rearward opening 74 that can accommodate the first vertical slide rail 30 and the first vertical slidable element 40.

The second vertical slide rail 230 is fastened to a rearward facing mounting plate of the first vertical slidable element 40. As previously noted, the horizontal section 73*h* of the L shaped bar of grip assembly 70 has a forward opening 73*o* through which passes the strong rod 72 and rearward opening 74 that can accommodate the first vertical slide rail 30 and the first vertical slidable element 40 as shown in FIG. 7. In the fully raised position (see FIG. 6), the first vertical slidable element 40 is located substantially under the horizontal section 73*h*. Compare the relative positions of the first vertical slidable element 40 in FIG. 6 and FIG. 7 with respect to the horizontal section 73*h*. In FIG. 7 the first vertical slidable element 40 protrudes upward through the opening 74.

Figure 10A:
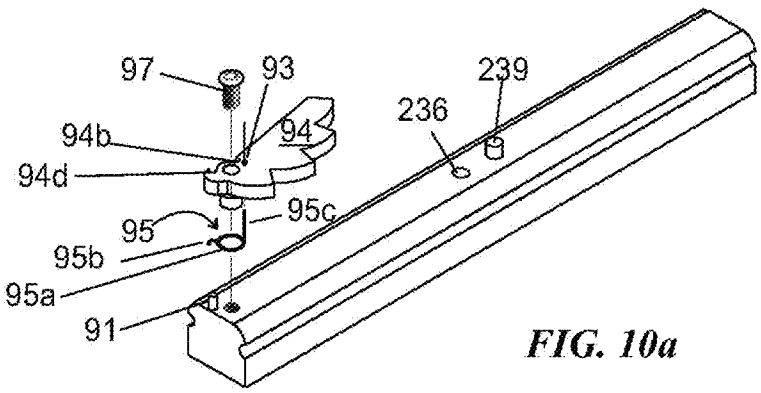
FIG. 10*a* is an exploded view of the spring loaded latch, where the spring is a coil that is centered on a pivot pin, a hook on the spring loops around a peg projecting from the second vertical slide rail, and a piercing pin of the spring projects through the latch through a pin opening through the latch, wherein out-board pivoting of the latch winds the coil spring.
Figure 10:
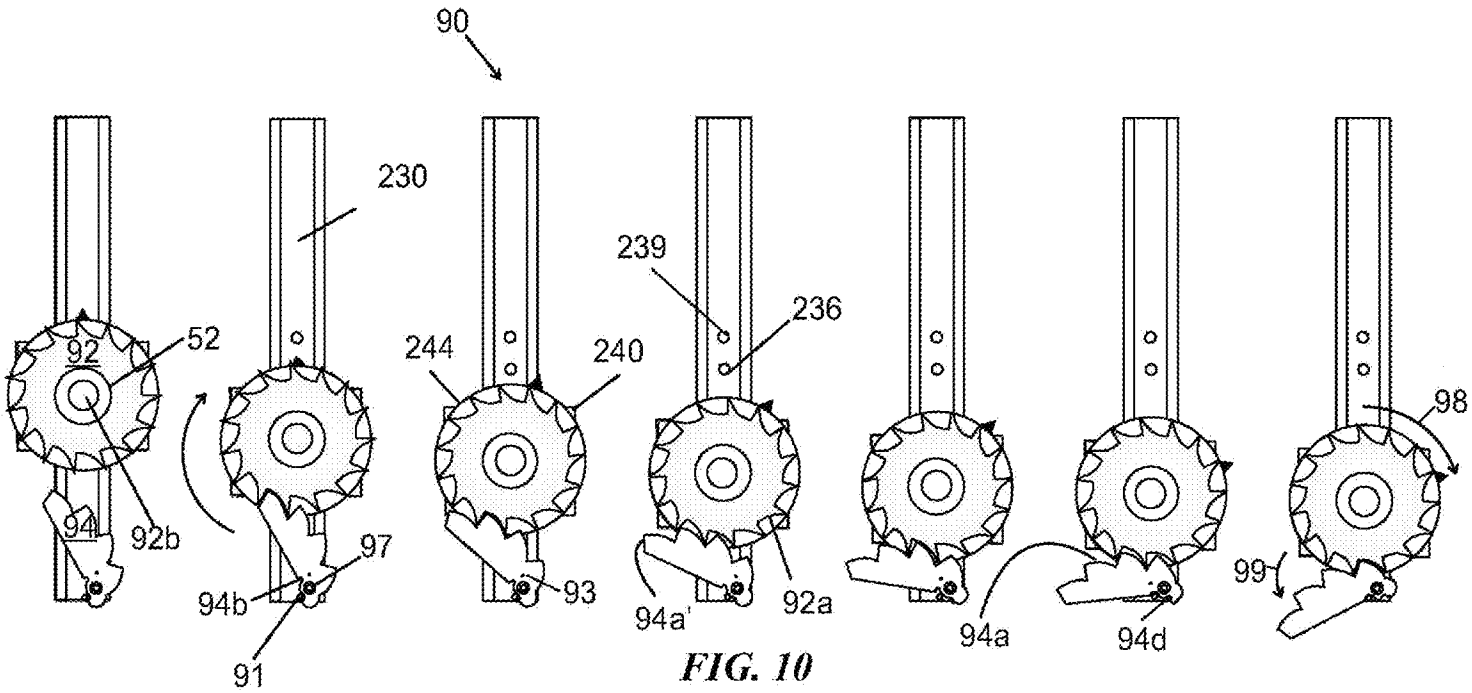
FIG. 10 is a serial view illustrating the action of an automatic rotation mechanism that has a geared cocking round lever on a slide and a spring loaded latch to rotate an axial connection on the strut assembly, where rotation can only occur in one direction, as the illustrated stepped latch induces rotation clockwise, and prevents counter-clockwise rotation.

The strut assembly 50 includes the automatic rotation mechanism 90, as shown in FIG. 10. The automatic rotation mechanism advances the rotatable multi-magazine manifold 60 to the next magazine, when the magazine in the magazine-well is ejected. The automatic rotation mechanism 90 harvests energy released when the magazine is ejected to increment the rotation. The amount of rotation is in a number of degrees as a fraction of a circle, where the number is 360 degrees divided by the number of magazine mounting faces. In the case of a pentagon, an increment of rotation is seventy two degrees (360/5=72). The automatic rotation mechanism harvests most of the energy released when the magazine is ejected to rotate to the next magazine, and as will be seen some this energy is recaptured when the next magazine is loaded into the magazine-well 120 of the firearm 100.

A side view of the apparatus 10 is shown in FIG. 8, where the pentagonal multi-magazine manifold is raised and, as shown, an upper magazine would be in the magazine-well. The adapter 20 has a beam 22 and additional fastening elements 24. The grip assembly 70 has a grip 71, which slides over the rod 72. Dashed lines suggest the grip's core annular element 75. Dashed lines also are used to suggest openings 73*o* and 74.

The second slidable element 240 has rearward mounting plate 244 to which is mounted the strut assembly 50. The strut has an axial plate 51 for mounting the strut to the rotatable multi-magazine manifold 60. Elements of the automatic rotation mechanism (see FIG. 10) are only partially visible. They include a geared cocking round lever 92 on the strut 50 and a latch 94 mounted on the second vertical slide rail 230. A covering plate 245 protects the many of the elements of the automatic rotation mechanism.

In FIG. 9 the apparatus has been lowered. The first vertical rail 30 is extended with a second vertical rail 230. The second vertical slide rail 230 is capped with an upper stop 237, and is mounted on the first vertical slidable element 40. The second vertical slide rail 230 functions as a retractable extension of the first vertical slide rail. The chamber end 81 of the magazine 80 feeds into the magazine-well. The L shaped bar 73 has an opening 74 (indicated by dashed lines) that permit the L shaped bar 73 to move past the first vertical slide rail 30 and the first vertical slidable element 40.

Rotation should not begin until the magazine has cleared the rim 121 of the magazine-well (see FIG. 5). The operative elements of one embodiment of the automatic rotation mechanism 90 are described in FIG. 10 and FIG. 10*a*. It is anticipated that other mechanisms are possible, for example those that use one-way bearings, and in disclosing this embodiment the concept is taught.

When a magazine is ejected from the magazine-well the first vertical slidable element drops carrying the second vertical slide rail to its extended position. The second vertical slidable element 240 is somewhat restrained, and it slides from its raised position, defined by an upper stop element 239 (see FIG. 10 and FIG. 10*a*) for the second vertical slidable element 240, and slowed by an adjustable restraint element 236, for example an adjustable detent, giving enough time for the magazine to clear the magazine rim before activating the automatic rotation mechanism. The automatic rotation mechanism 90 is shown in FIG. 10 as a series of views from left to right as seen from the manifold 60.

When a magazine is loaded into a magazine-well the upper stop element 239 using the slidable grip assembly 70, the second vertical slidable element is moved upward until it abuts the upper stop element 239, wherein the second vertical slide rail 230 is raised, collapsing the second vertical slide rail 230 on top of the first vertical slide rail 30, shortening the overall length of the extendable piggybacked rails.

The second vertical slidable element 240 starts sliding down the second vertical slide rail 230 almost immediately when the current magazine is released. It is slowed slightly by the adjustable restraint element 236. The second vertical slidable element 240 has a front protective plate 244, that is protects the automatic rotation mechanism 90. An axial rod 92*b* projects rearward from the front protective plate 244, and it functions as a bearing for a geared cocking round lever 92 and is coaxial with the strut 50, wherein the strut 50 can rotate on the axial rod 92*b*. The geared cocking round lever 92 is mounted on the strut. The geared cocking round lever 92 has scalloped gears 92*a*. A spring loaded latch 94 having positively scalloped gears 94*a* and an abutting straight section 94*a*' is mounted to the second vertical slide rail 230. The positively scalloped gears 94*a* are selected to mesh with the scalloped gears 92*a*, but the gears are skewed so as to induce more tangential force in one direction and slippage in the opposing direction.

FIG. 10*a* shows detent 250 on the rail side of the second vertical slidable element 240 that is mated with adjustable resistance element 236 when the magazine is chambered inside the magazine well. As shown in FIG. 10*a* the spring 95 of the spring loaded latch 94 has a coil 95*a* that is centered on the pivot pin 97, a hook 95*b* that loops around a peg 91 projecting from the second vertical slide rail 230, and a piercing pin 95*c* that projects through the latch 94 through a pin opening 93. Rotation of the latch is limited by peg 91 against a start notch 94*d* and a stop notch 94*b*. Prior to contact of the geared cocking round lever 92 with the spring loaded latch 94, the spring loaded latch is nearly upright, with the peg 91 seated in the start notch 94*d*. When the lever 92 contacts the latch 94, it initially is with an abutting straight end section 94*a*' of the latch as shown in the second of the series of seven views. The meshing produces a tangential force on the on geared cocking round lever 92, causing it to rotate clockwise. The latch responds by swinging counterclockwise 99, exposing additional positively scalloped gears 94*a*, which cause further clockwise rotation 98 of the lever. Rotation ceases when the stop notch 94*b* rests against the peg 91, as shown in the last view of the series. The swing action tensions the coiled spring 95. The next magazine is now aligned, ready to be moved into the magazine-well. Loading is performed by simply raising the slidable grip assembly 70, if available, or gripping the manifold or a magazine on the manifold to move the aligned magazine into the well. The weight of the apparatus can be used to load the next magazine by lifting the firearm upright or even inverted, as alignment is maintained.

Figure 11A:
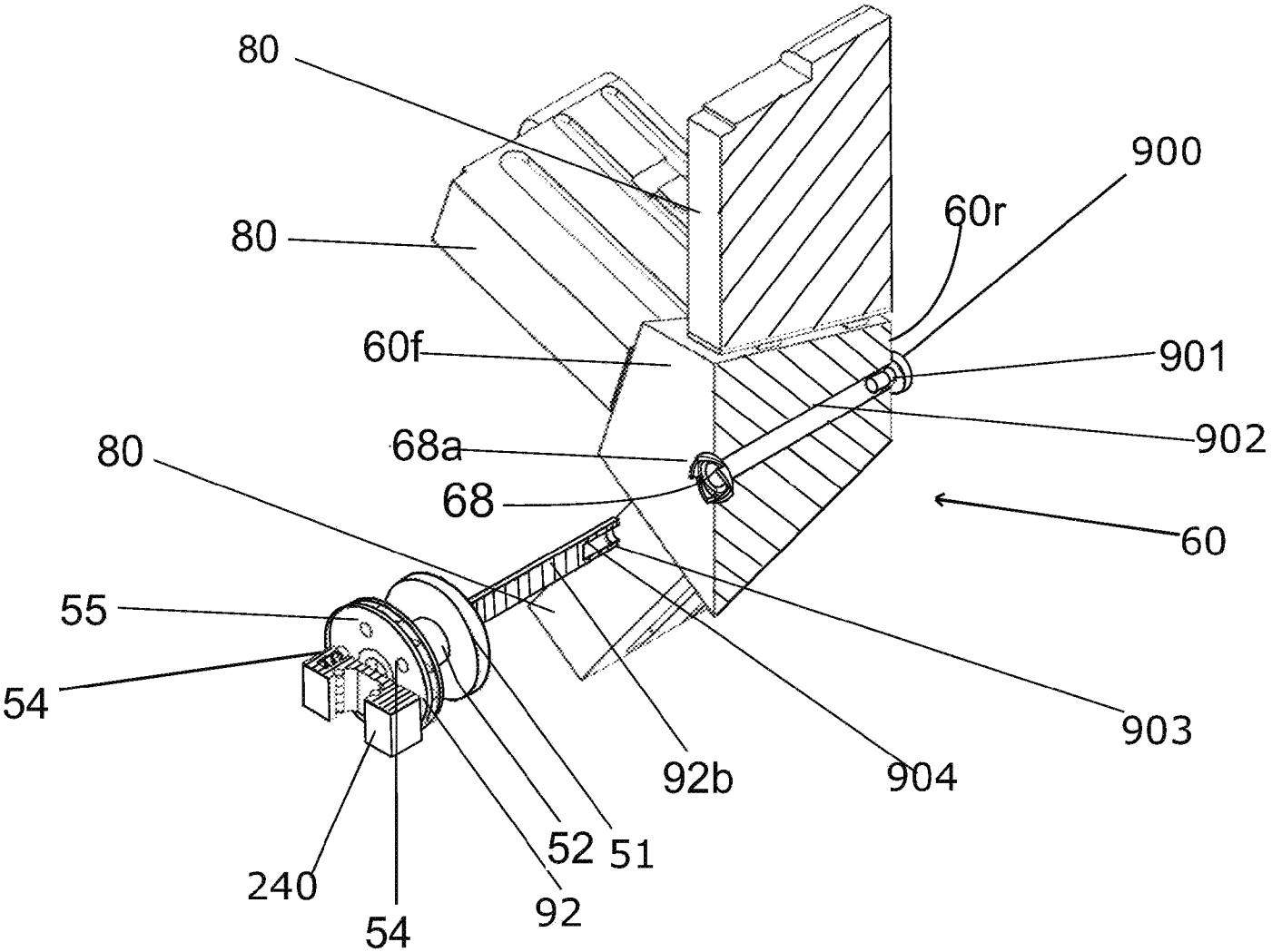
FIG. 11*a* is an elevated partially exploded cutaway view of a quick connect rotatable multi-magazine.
Figures 12A, 12B, 12C, 12D:
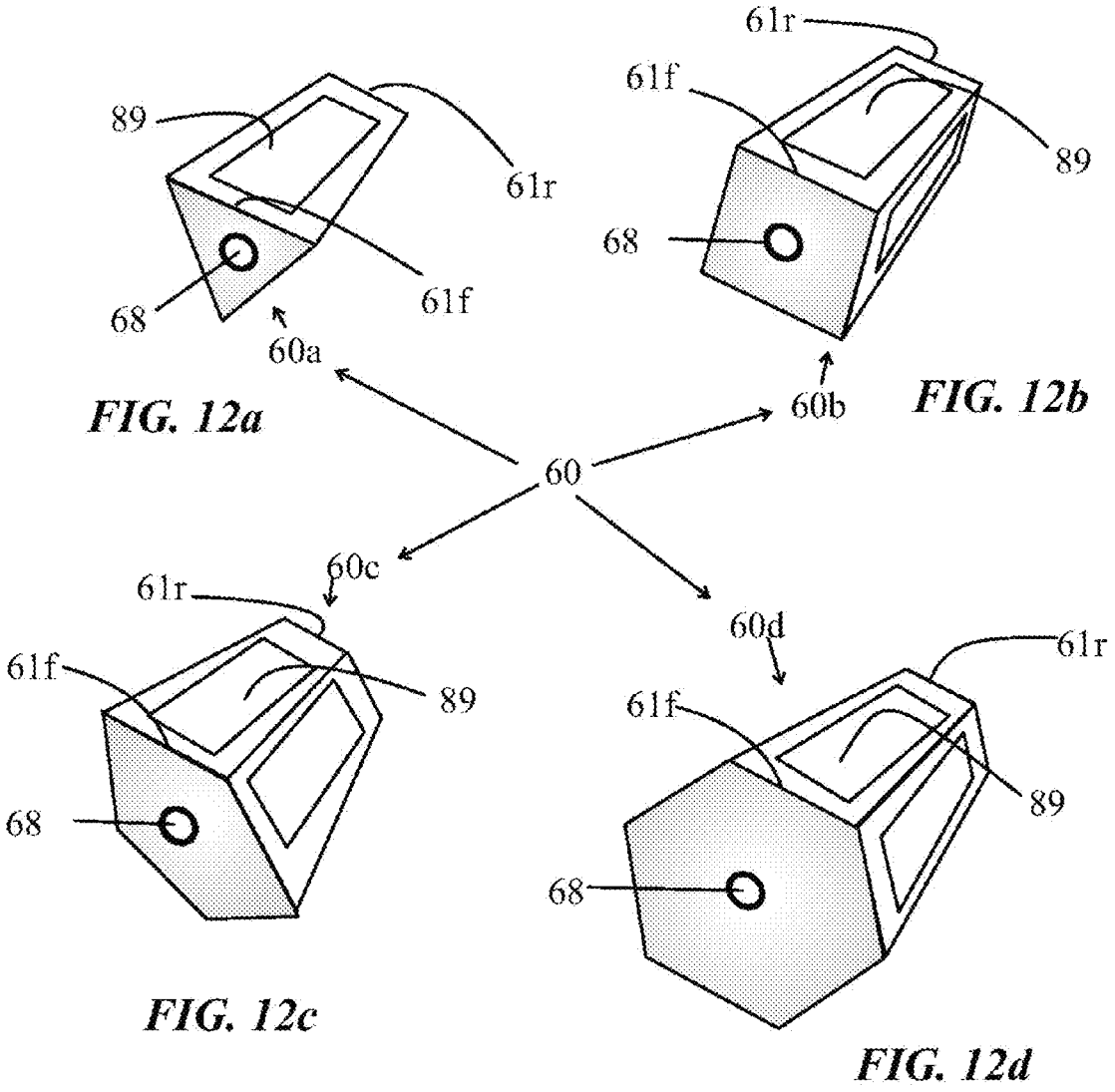
FIG. 12*a* is an elevated perspective view of a rotatable multi-magazine manifold that is a trigonal polygonal frustum with three mounting faces.
FIG. 12*b* is an elevated perspective view of a rotatable multi-magazine manifold that is a tetragonal polygonal frustum with four mounting faces.
FIG. 12*c* is an elevated perspective view of a rotatable multi-magazine manifold that is a pentagonal polygonal frustum with five mounting faces.
FIG. 12*d* is an elevated perspective view of a rotatable multi-magazine manifold that is a hexagonal polygonal frustum with six mounting faces.

Raising the geared cocking round lever 92 does not mesh gears as the spring loaded latch just rides over the lever's gears 92*a*, consequently there is no additional rotation. FIG. 11*a* further clarifies the mechanism. Additionally as shown in FIG. 11*a*, when the desired rotation is achieved a detent on the second vertical slidable element 240 clicks into place once the cocking round lever 92 has rotated the desired number of degrees.

In FIG. 11*a*, frontal face 60*f* of the rotatable multi-magazine manifold 60 has an alignment cog 68*a* along an edge of the axial opening 68 to a central bore 902 of the rotatable multi-magazine manifold 60. The central bore 902 allows axial rod 92*b* to pass into the rotatable multi-magazine manifold's central bore 902, and fit into slots (not shown) on the axial positioning plate 51 to ensure proper positioning of rotatable multi-magazine manifold 60 with the magazine well. The rearward face 60*r* of the rotatable multi-magazine manifold has a quick release 900, which when compressed, retracts retaining balls 901 out of expansion chamber 903 of bore 904 in axial rod 92*b* and allows easy removal of the entire rotatable multi-magazine manifold. FIG. 11*a* also shows detents 54 in a geared cocking round lever 92 that correspond with adjustable resistance element 54 on the partially cut-away second vertical slidable element 240 so that when geared cocking round lever 92 has rotated the correct incremental number of degrees, the spring decompresses to fill detent 55 and prevent further rotation clockwise or counterclockwise so the magazine is properly aligned with the magazine well.

The tensioned coiled spring 95 returns the latch 94 to its upright position as shown in the first view and second view of the series. Only, after the next magazine is ejected will rotation again move the next incremental number of degrees. The automatic rotation mechanism 90 harvests the energy released during ejection to power the automatic rotation mechanism, conserving some energy with the coiled spring 95.

FIG. 11, 11*a*, and FIGS. 12*a*-12*d* have previously been discussed.

Figure 13:
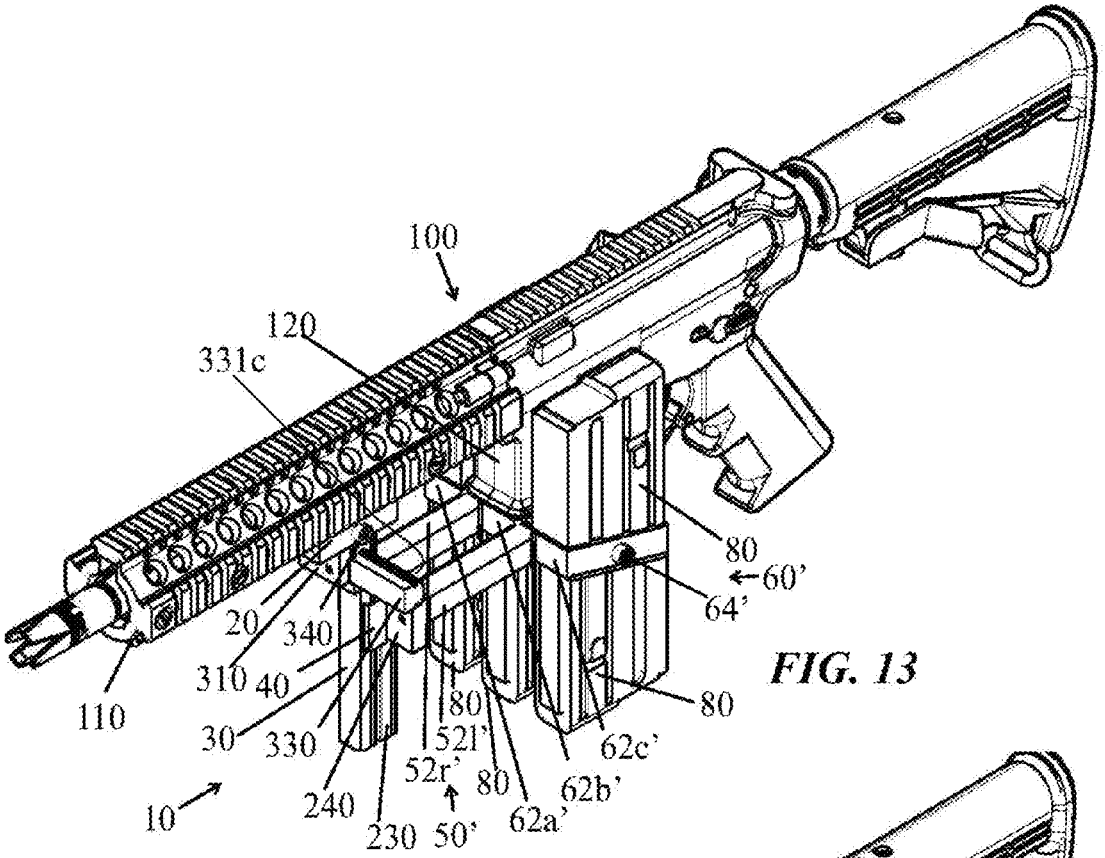
FIG. 13 is an elevated perspective view of the apparatus mounted on a firearm having a handguard rail, where the apparatus has a semi-rotatable multi-magazine manifold with a set of two or more block polygons, wherein each block polygon can be fitted with a pair of opposing magazines, wherein the illustrated semi-rotatable multi-magazine manifold can be shifted and the manifold has a set of three block polygons with a common axis and three pairs of opposing magazines, wherein the next magazine having ammunition is loaded into an empty magazine-well ejection by either flipping the semi-rotatable manifold to the opposing magazine or by shifting the vertical rails affixed to a first horizontal slidable element, therein moving the manifold inward or outward to an adjacent magazine, and then shoving the aligned magazine into the magazine-well.

A variation of the apparatus 10 is illustrated in FIG. 13, wherein the apparatus has a semi-rotatable multi-magazine manifold 60'. The semi-rotatable multi-magazine manifold 60' provides rotation through only 180 degrees. As will become clear, the magazines are mounted on the semi-rotatable multi-magazine manifold 60' having a face that is angled when positioned on a semi-rotatable strut assembly 50' to compensate for the angle of the base of the magazine. The magazines are still aligned with the magazine-well, and the manifold 60' rotates in the plane of the paper, as was conceptually described in FIGS. 1*a*-1*d*. The semi-rotatable manifold makes it possible to repeatedly load and eject multiple magazines without visually disengaging from a target.

In the Illustrated semi-rotatable embodiment of the apparatus the adapter 20 is mounted directly to a handguard or as illustrated to a handguard rail 110 of a firearm 100. As illustrated in FIG. 13 the apparatus includes an adapter 20, a mounting block 310, and a horizontal slide rail 330 that is mounted on the mounting block 310 at right angles to the adapter. The horizontal slide rail 330 has a horizontal slidable element 340 that can slide across a rearward side of the horizontal slide rail 330. A first vertical slide rail is rigidly attached to the horizontal slidable element 340. The first vertical slide rail 30 has an overlapping second vertical slide rail 230 that functions as an extension of the first vertical slide rail 30. The second vertical slide rail 230 is mounted on a first vertical slidable element 40. The second vertical slide rail 230 has a second vertical slidable element 240. The vertical slide rails and vertical slidable elements are jointly referred to as a vertical slide rail assembly. Movement of the horizontal slidable element 340, and the affixed vertical slide rail assembly is in the Z-plane, which is into or out-of the page of the side view of the apparatus relative the firearm.

Figure 18B:
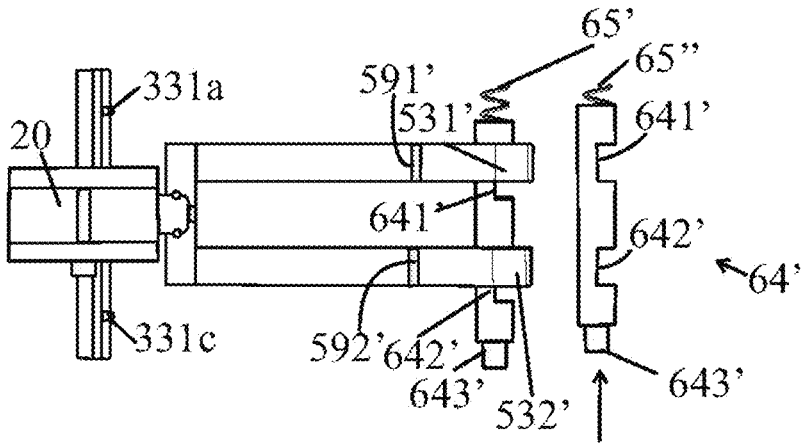
FIG. 18*b* is an overhead view of the spring loaded quick connect axle (without the polygons) and the strut assembly apparatus, in which is illustrate that the axle is keyed with slots, and that under pressure it can aligned with the bearing gaps for quick release or quick connect.

The horizontal slide rail has one or more Z-plane stopping points that the horizontal slidable element can be moved, where a number Z of stopping points nominally matches the number of blocks included in a semi-rotatable multi-magazine manifold 60'. See FIGS. 21*a*-21*d* for examples of semi-rotatable multi-magazine manifold 60' having a plurality of blocks 62'. Each Z-plane stopping point is selected so that at least one of the magazines affixed to a block on the semi-rotatable multi-magazine manifold is spatially aligned between a right side and a left side of a magazine-well. In FIG. 13 there are three blocks 62*a*',62*b*',62*c*', so there are three stopping points on the horizontal slide rail. The stopping points 331*a*, 331*b*, 331*c* are not visible in FIGS. 13 and 14, but they are shown in other drawings. The two outboard stopping points 331*a* and 331*c* are shown in FIG. 18*b*, and the center stopping point 331*b* is shown in FIG. 22.

The semi-rotatable strut assembly 50' is mounted on a rearward face of the second vertical slidable element 240. The illustrated semi-rotatable strut assembly 50' has two struts a left strut 521', and a right strut 52*r*'. The struts are parallel and have a length that is selected so that the semi-rotatable multi-magazine manifold has at least one magazine affixed to a block that is spatially aligned front-to-back with the magazine-well 120. In general the strut assembly 50' has one less strut than there are blocks 62'. A maximum of five blocks 62' is anticipated, due to the practicality of size and weight limits for maneuverability of the firearm, so a maximum of four struts are anticipated, however, theoretically, these numbers are not finite.

FIGS. 21*a*-21*d* illustrate semi-rotatable multi-magazine manifolds 60' having a plurality of blocks 62', where the plurality is two to five blocks (62*a*' & 62*b*') up to (62*a*' & 62*b*' & 62*c*' & 62*d*' & 62*e*'). All the manifolds have a pair of connecting rods 681', 682' and one axle 64'. All the blocks of the different manifolds are separated by spacers 691'. Each block has opposing mounting faces. For example FIG. 21*b* has six mounting faces 621' (see FIG. 18) and 622', 623' (see FIG. 18) and 624', 625' (see FIG. 18) and 626'.

Figure 22:
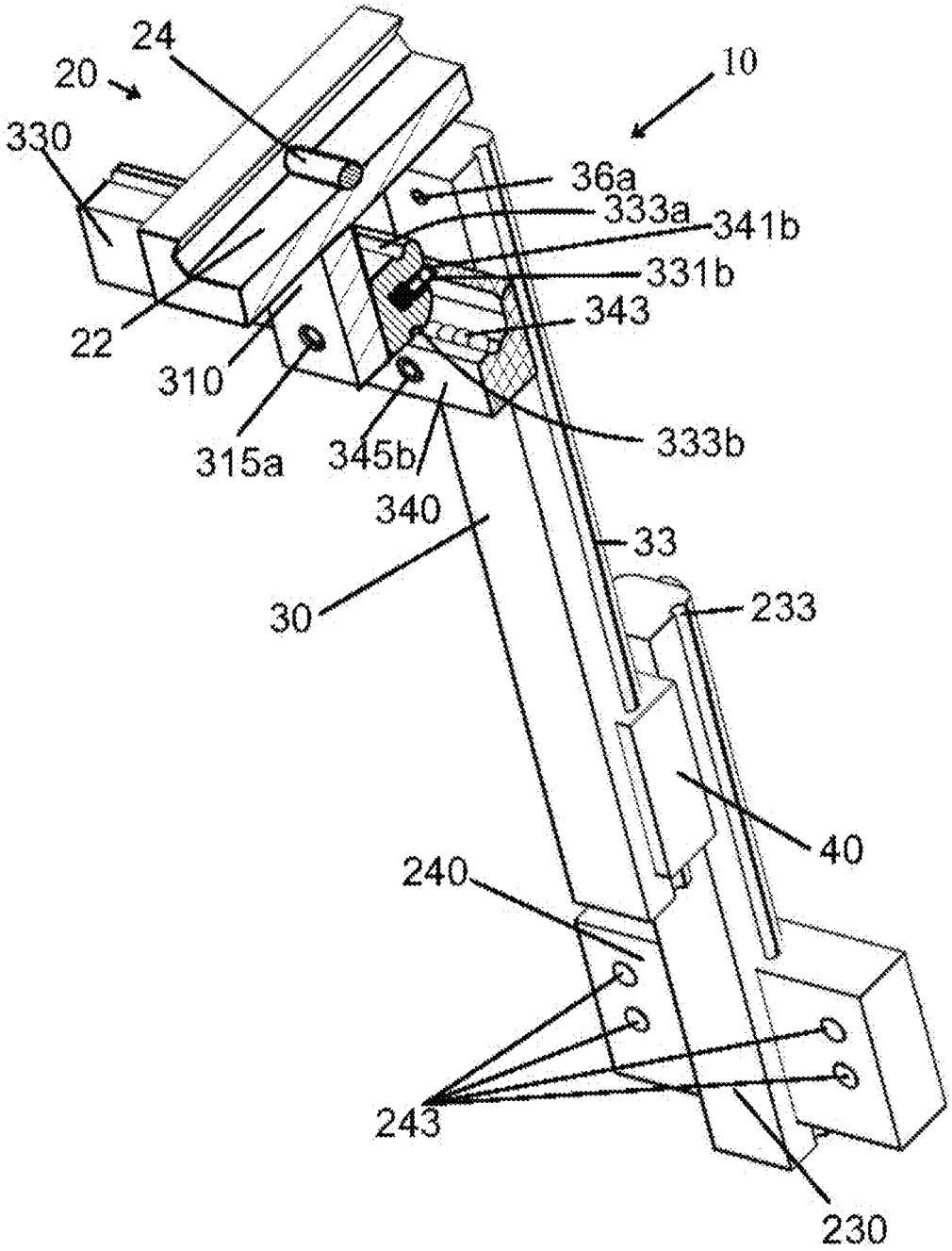
FIG. 22 is an cutaway elevated perspective side view of the apparatus illustrated in FIG. 19, wherein the apparatus has a horizontal slide rail with a plurality of detent elements positioned at two or more desired stopping points along the horizontal slide rail (only one is shown), wherein a horizontal slidable element has a recessed depression that faces the rearward side of the horizontal slide rail, and when the detent, which is illustrated as a spring loaded intersecting element that is press fitted on rearward side of the horizontal slide rail, will move into the recessed depression, therein stopping the horizontal slidable element at a desired stopping point.

FIG. 22 provides an example of a stopping point 331*b*' on the first horizontal slide rail 330 is. The slidable horizontal slidable element 340 has a recessed depression 341 that can receive a detent 331*b*' that is press fitted in the horizontal slide rail 330. The slidable horizontal slidable element 340 could alternately be fitted with the detent, but the downside is that the slidable horizontal slidable element 340 would not move as easily between points, and the change in drag/friction between points is smaller and therefore not as easily detected. In the current embodiment, the horizontal slide rail is fitted with three detents instead of one in the slidable horizontal slidable element 340 provides a more pronounced stop, and there is less wear, therein assuring alignment of a magazine on the manifold with the magazine-well.

Figure 14:
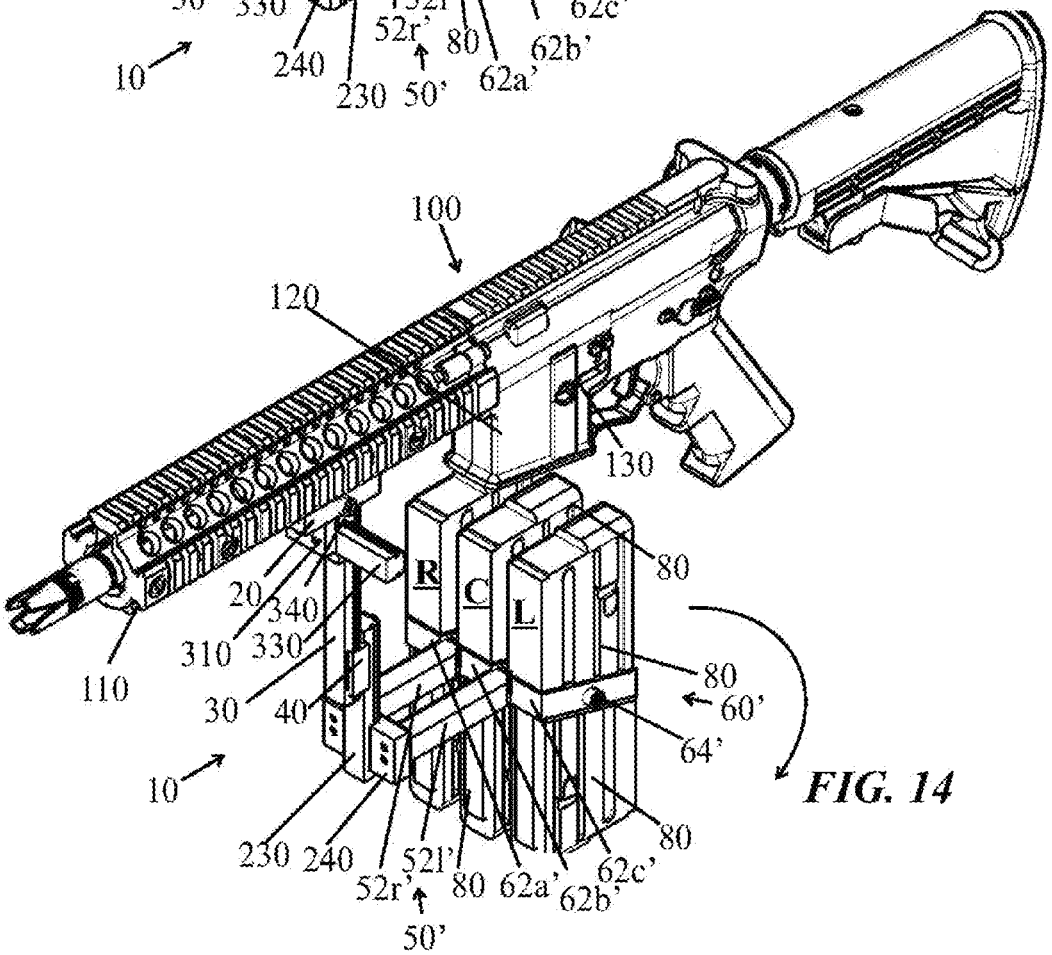
FIG. 14 is an elevated perspective view of the apparatus shown in FIG. 13, wherein one of the two center magazines has been ejected and the apparatus is in the lowered position.

In FIG. 13, there is currently a magazine 80 is in the magazine-well 120. The current magazine is ejected by simply actuating the firearm's magazine ejection device 130, which is more clearly seen in FIG. 14. In FIG. 14 the current magazine has been ejected causing the magazine on the semi-rotatable manifold, the semi-rotatable strut assembly and the vertical slide rail assembly to drop. To load the next magazine into the empty magazine-well the semi-rotatable manifold 60' is either flipped to the opposing magazine or the vertical slide rail assembly is shifted to a new stopping point by sliding the horizontal slidable element 340, therein moving the manifold inboard or outboard, and then shoving the aligned magazine into the magazine-well. FIG. 14 shows the apparatus immediately following ejection.

Figure 15:
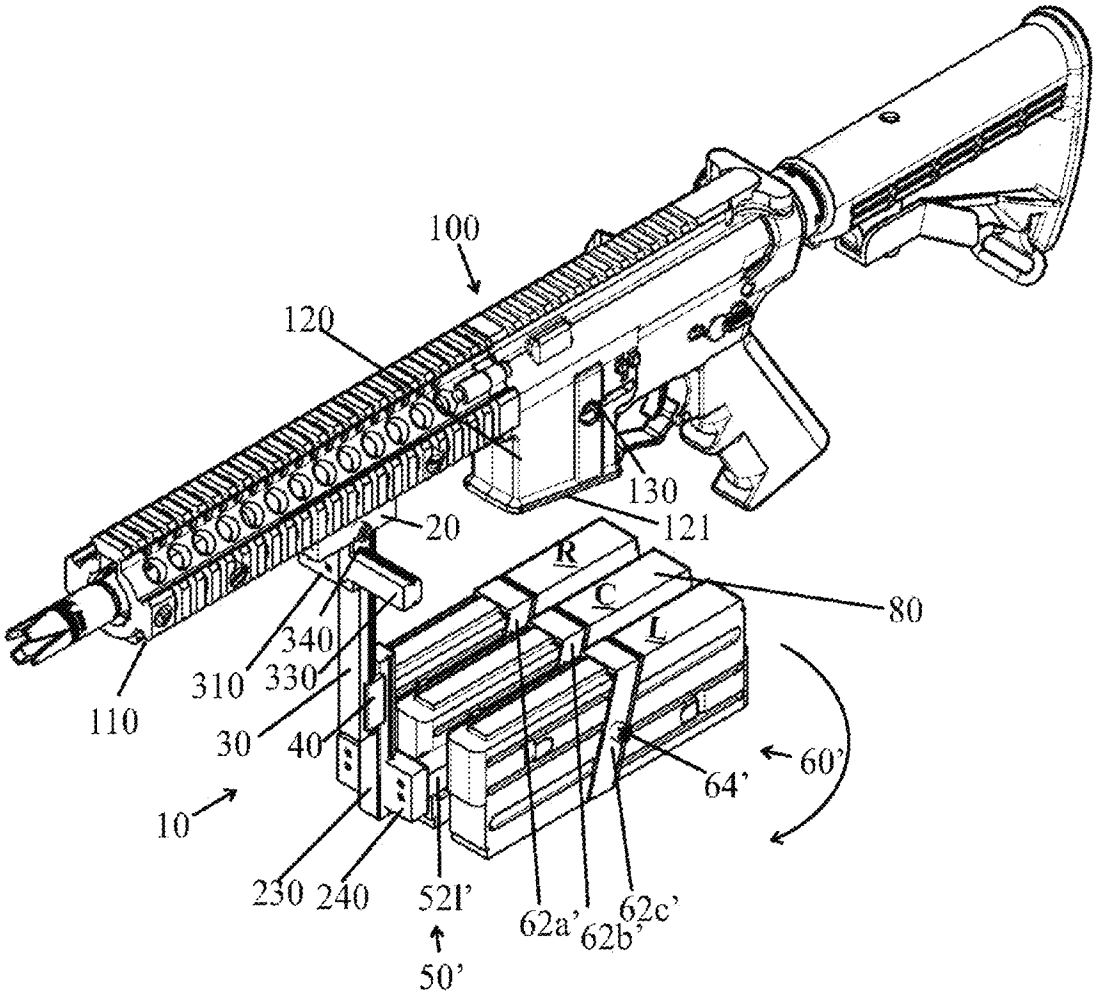
FIG. 15 is an elevated perspective view of the apparatus shown in FIG. 13, illustrating that in the lowered position the semi-rotatable multi-magazine manifold can be rotated 180 degrees, so that the three magazines on a top-side are rotated to a bottom-side, where the new top-side magazine can be chambered into the magazine-well by shifting the horizontal slidable element on the horizontal slide rail to either a center position or either of the two outer positions, and raising the selected magazine into the magazine-well.
Figure 18:
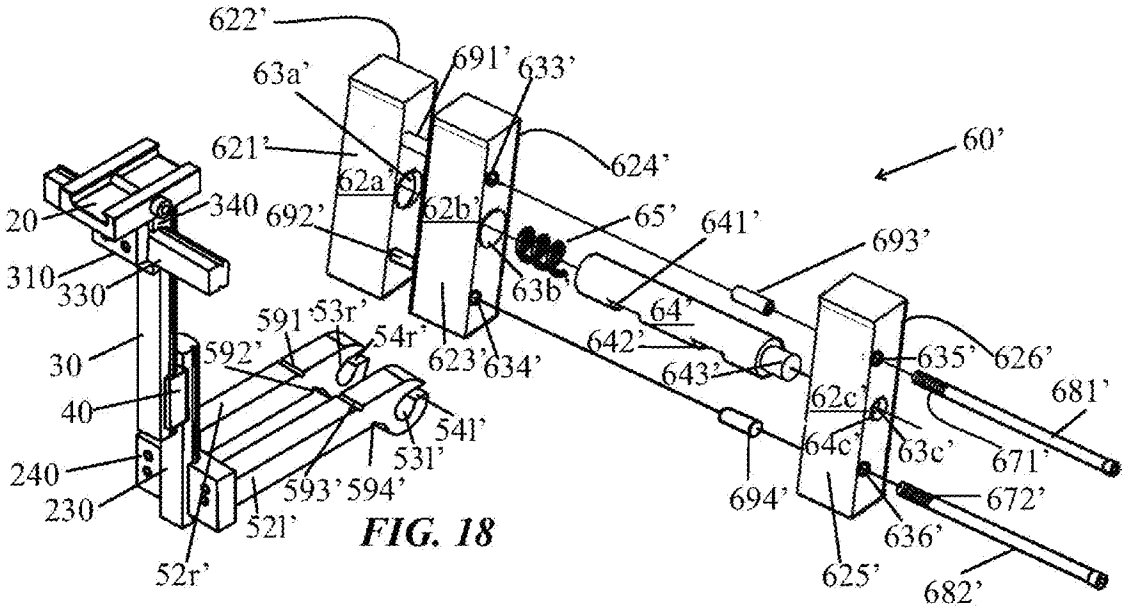
FIG. 18 is an exploded view of an apparatus with a quick connect semi-rotatable strut assembly and a quick connect semi-rotatable multi-magazine manifold that has a set of three block polygons with a total of six mounting faces, wherein each mounting face can be fitted with a magazine, and the polygons share a spring loaded quick connect axle, separated by spacers and linked by offset connecting rods.
Figure 19:
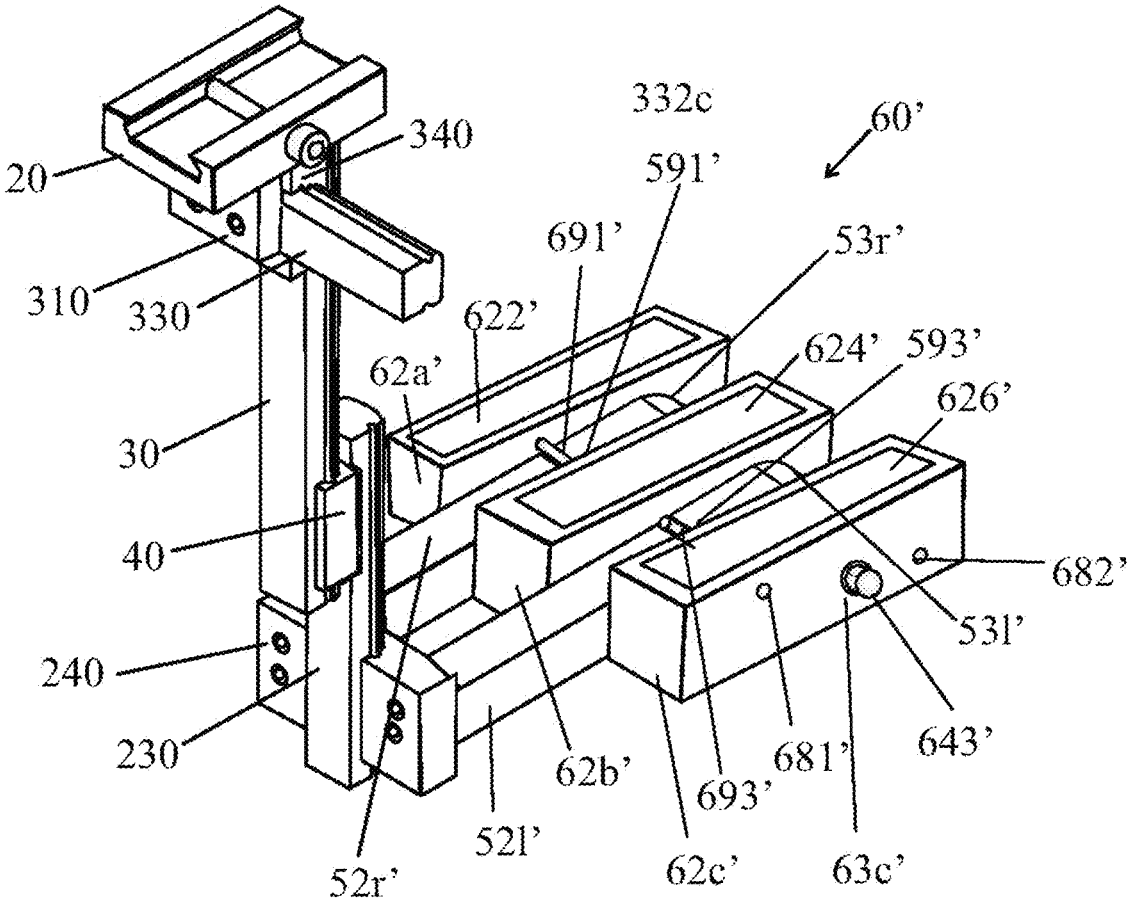
FIG. 19 is an elevated perspective view of the illustrated embodiment shown in FIG. 16*b* without any magazines seated on the multi-magazine manifold.

FIG. 15 illustrates the semi-rotatable multi-magazine manifold 60' in the process of being flipped. The magazines labelled "R", "C", "L" that were previously shown in FIG. 14 have been turned about 90 degrees. They must be turned a full 180 degrees, so that the three magazines that were on the top-side and righted are rotated to a bottom-side, where they are inverted and reversed. Whether rotation is clockwise or counter-clockwise is determined by the manifold 60' current position, as rotation between the struts is not allowed. As show in FIG. 18 and FIG. 19, the blocks 62' making up the manifold 60' are held together with connecting rods 681', 682' on opposing sides of a center axle 64'. The blocks are separated by spacers 691', 692', 693,'694'. The rods and spacers prevent rotation between the struts, and in fact they act as stopping elements. As shown in FIG. 18, the struts 52*l*',52*r*' have top-side grooves 591','593' can only receive the top-side spacers 691',693', and the bottom-side grooves 592',594' can only receive the bottom-side spacers 692',694'. So, if the manifold 60' as shown in FIG. 19 is positioned with the top-side spacers 691',693' in the top-side grooves 591','593', then flipping is only possible if the rotation is clockwise. Of course, if the bottom-side spacers 692',694' are in the bottom-side grooves 592',594' then only counter-clockwise rotation is possible.

After flipping potentially all the now top-side magazines can be chambered into the magazine-well, one will be aligned. The other now top-side magazines can be chambered by shifting the horizontal slidable element on the horizontal slide rail to either a center position or either of the two outer positions, where each position is in alignment with the magazine-well 120. The manifold is raised, loading the selected magazine into the magazine-well.

Figure 16A:
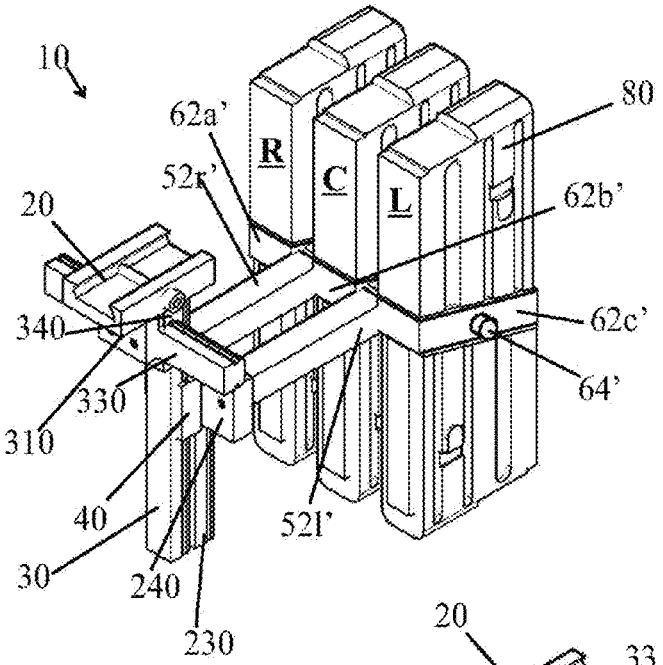
FIG. 16*a* is an elevated perspective view of the apparatus sans the firearm shown in FIG. 13, wherein the semi-rotatable multi-magazine shiftable manifold is in the raised position.
Figure 16B:
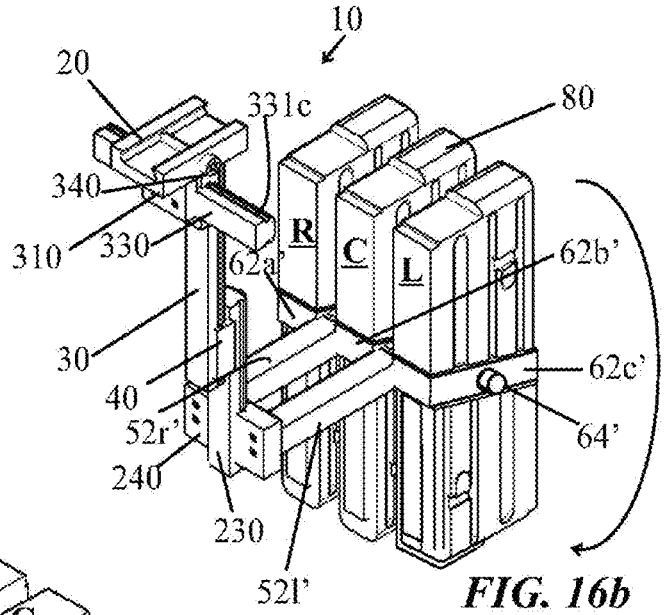
FIG. 16*b* is an elevated perspective view of the apparatus in FIG. 14 sans the firearm shown, wherein the semi-rotatable multi-magazine manifold is centered and in the lowered position.
Figure 16C:
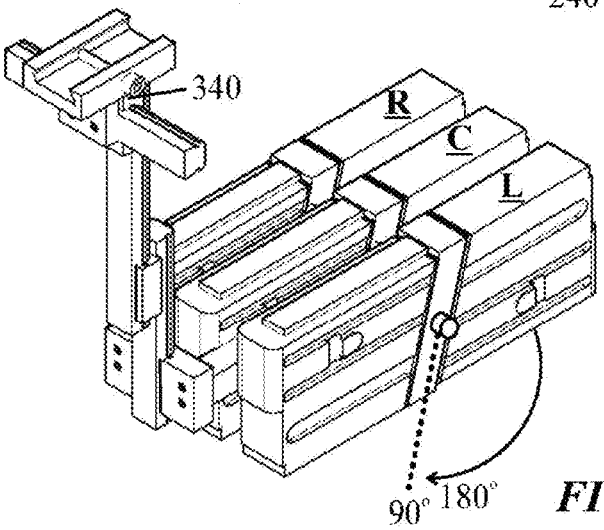
FIG. 16*c* is an elevated perspective view of the apparatus shown in FIG. 15 sans the firearm, wherein the semi-rotatable multi-magazine manifold is lowered and partial rotated so that the new top-side magazines are upward.

FIG. 16*a* illustrates the apparatus shown in FIG. 13 without the firearm. FIG. 16*b* Illustrates the apparatus shown in FIG. 14 without the firearm, and FIG. 16*c* illustrates the apparatus shown in FIG. 15 without the firearm. The most notable feature is that while the magazines and the vertical slide assembly are parallel, the blocks 62*a*',62*b*',62*c*' are angled so that the face when the standard magazine 80 is mounted it has a vertical orientation. This is easier to see in FIG. 17. The angle of block 62*c*' is selected so that the face 643' compensates for the angle of the base 82, which is often slopped. The slope angle is 82*a*. This is a real advantage, as a user can use standard magazines on the semi-rotatable multi-magazine manifold 60', or if the base is not not-angled, the manifold can be selected for a non-angled base.

Figure 18A:
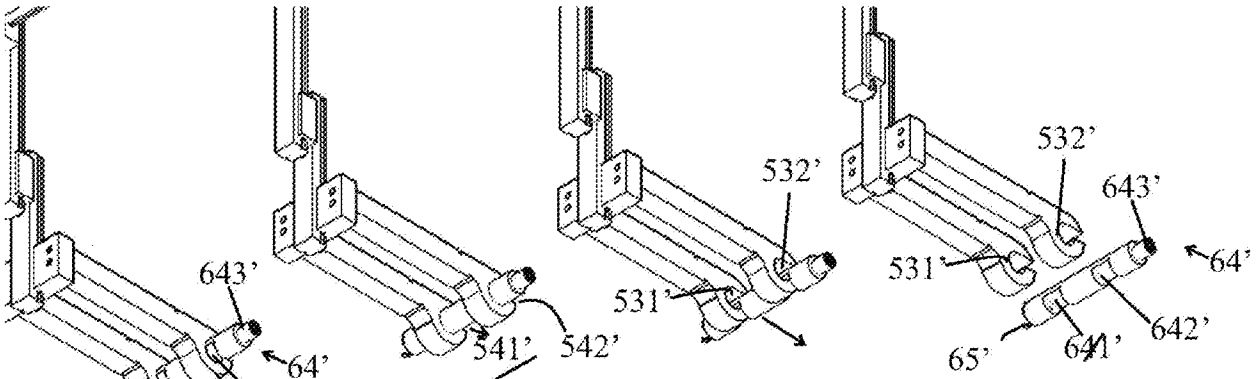
FIG. 18*a* is a series of views illustrating how the spring loaded quick connect axle is removed from the semi-rotatable forked strut assembly, where the axle has a pair of slotted sections that can pass through a pair of bearing gaps on the strut assembly only when the slotted sections are springedly pressed into alignment with the bearing gaps, wherein, as shown in the left most drawing, an end of the axle has a spring seated in a hole in the polygon (as shown in FIG. 18 and FIG. 18*b*) that pushes the axle to the left (when the firearm is in the upright-shooting position) where the slotted sections are not aligned with the bearing gaps, in the second view the spring is compressed by depressing a button-like undercut end portion of the axle, forcing the axle to the right, therein aligning the slotted sections with the bearing gaps, in the third view the axle is pulled through the bearing gaps, and in the fourth view the axle has cleared the pair of bearing gaps.

In the embodiment illustrated in FIG. 18 and FIG. 18*a* the left strut $52_l'$ and the right strut 52*r*' each have a bearing 53*l*',53*r*' with a gap $54_l'$, 54*r*', wherein the semi-rotatable multi-magazine manifold 60' has a quick connect axle 64' (as shown in FIG. 18*ba* and FIG. 18*b*) that can be fitted within the semi-rotatable multi-magazine manifold 60'. The quick connect axle 64' enables the semi-rotatable multi-magazine manifold 60' to be positioned on the struts, with the axle 64' mounted in the bearings **53*l*',53*r*'**. No disassembly of the bearings or the manifold is required.

Figure 17:
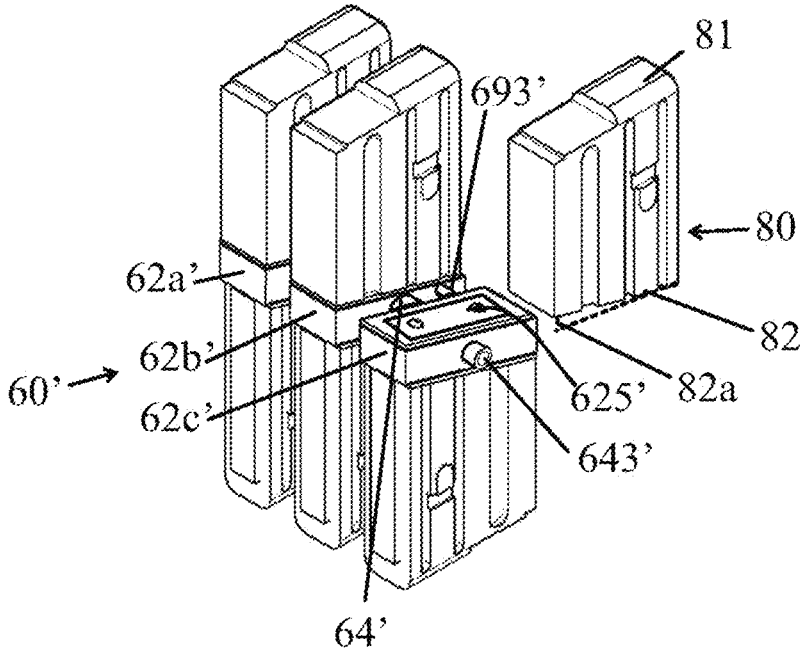
FIG. 17 is an elevated perspective view illustrating how a standard magazine is attached to a mounting face of a semi-rotatable multi-magazine manifold.

Also in FIG. 18, all six mounting faces are numbered 621', 622', 623', 624', 625', 626'. Three of the faces are marginally visible. Each mounting face can be fitted with a magazine, as shown in FIG. 17 and others. There are a total of six magazines. In other variations the manifold shown in FIG. **21*a* could hold four magazines; in FIG. 21*c* could hold eight magazines; and the manifold in FIG. 21*d* could hold ten magazines. Typically, the magazines hold twenty or fewer rounds of ammunition. The magazines illustrated in FIG. 17 are a ten round clip, which is atypical, but gaining in usage. As shown in FIG. 18 and to a lesser extent FIG. 20, the block polygons 62*a*', 62*b*', 62*c*' share a spring loaded quick connect axle 64', and are equally spaced by hollow spacers 691', 692',693',694' through which extend connecting rods 681', 682' that are threaded headed pins. As previously discussed, the spacers are positioned to also function as stops, when the semi-rotatable multi-magazine manifold 60'** is flipped.

As can be seen in FIG. 18 the axle 64' is keyed so that when properly positioned slots 641' and 642' can pass through the bearing gaps **54*r*' and 541' as shown in FIG. 18*a* and FIG. 18*b*. As diagrammatically illustrated as a sequence of views in FIG. 18*a* this is possible only when pressure is applied to axle button 643', compressing the compression spring 65', which aligns the slots 641', 642' with the bearings slots 53*r*' and 531'. As soon as pressure is released, the compression spring expands 65', the axle shifts, the slots and gaps are no longer aligned, and the axle 64' is retained because the bearings see the full diameter of the axle. To achieve this, each of the blocks 62*a*', 62*b*', 62*c*'** has certain features.

Figure 20:
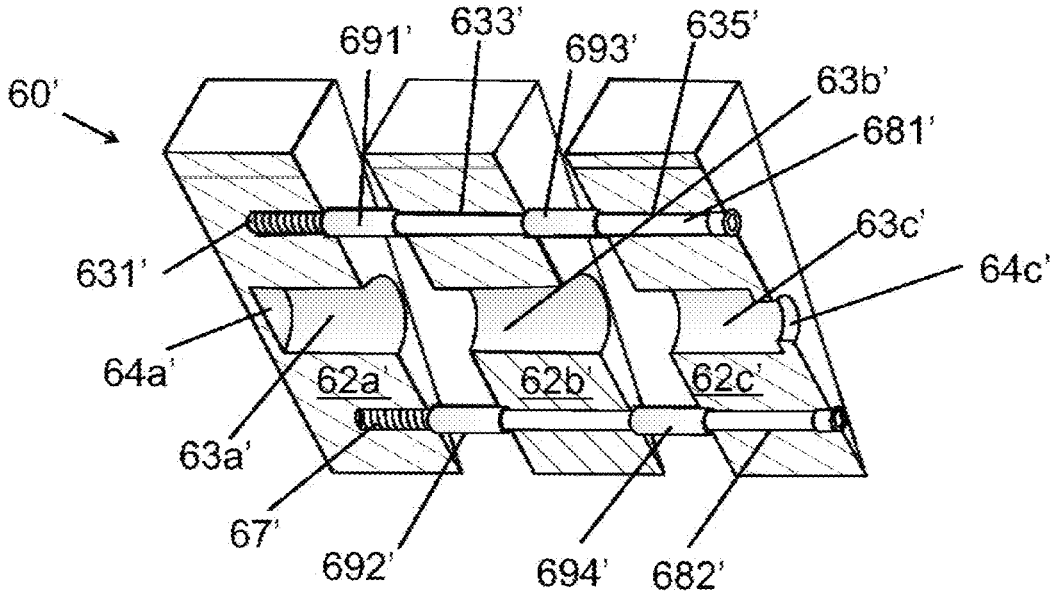
FIG. 20 is a diagonal cross-section perspective view of the semi-rotatable multi-magazine manifold shown in FIG. 18, wherein the illustrated assembled manifold is illustrated without the axle to highlight the differences in the block polygons.
Figure 21A:
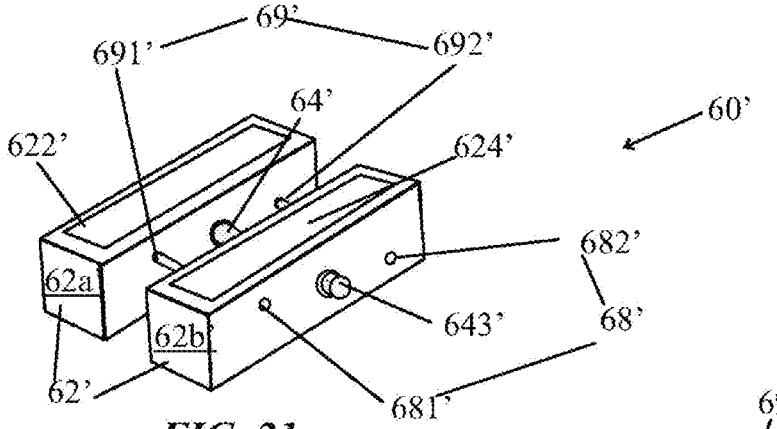
FIG. 21*a* is a block polygonal semi-rotatable multi-magazine manifold that has N blocks, where N is 2, and it would be supported by a strut assembly having N−1 struts, where N−1 struts is one.
Figure 21B:
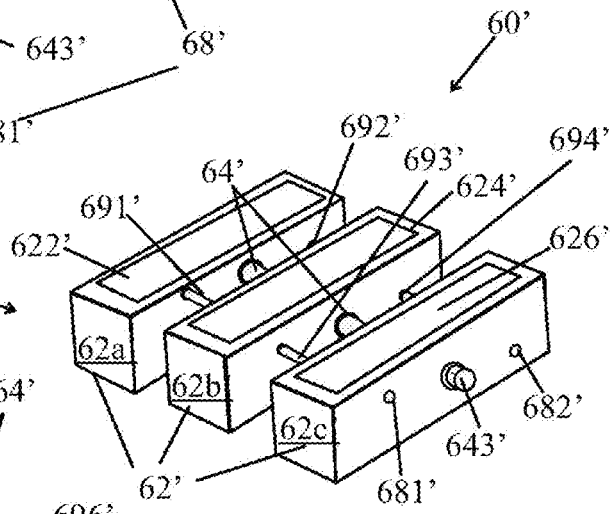
FIG. 21*b* is a block polygonal semi-rotatable multi-magazine manifold that has N blocks, where N is 3, and it would be supported by a strut assembly having N−1 struts, where N−1 struts is two.
Figure 21C:
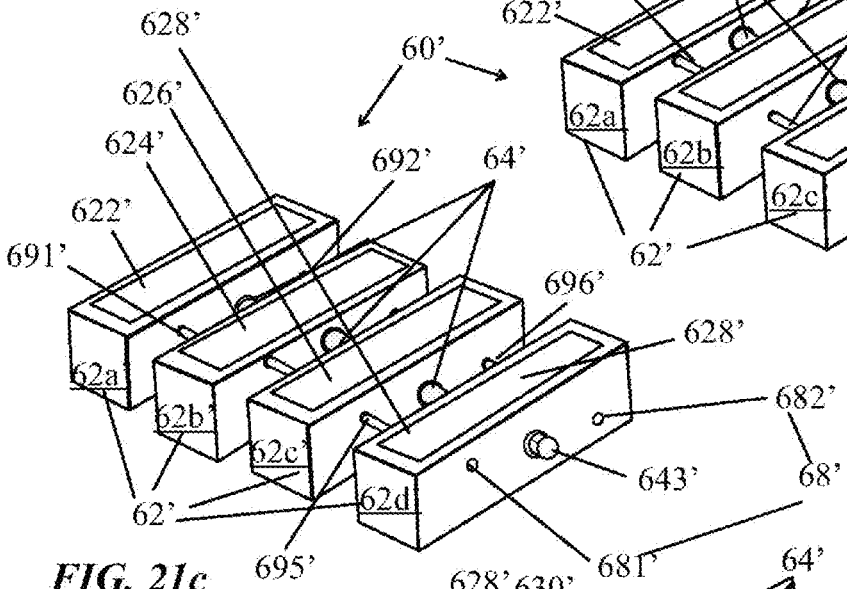
FIG. 21*c* is a block polygonal semi-rotatable multi-magazine manifold that has N blocks, where N is 4, and it would be supported by a strut assembly having N−1 struts, where N−1 struts is three.
Figure 21D:
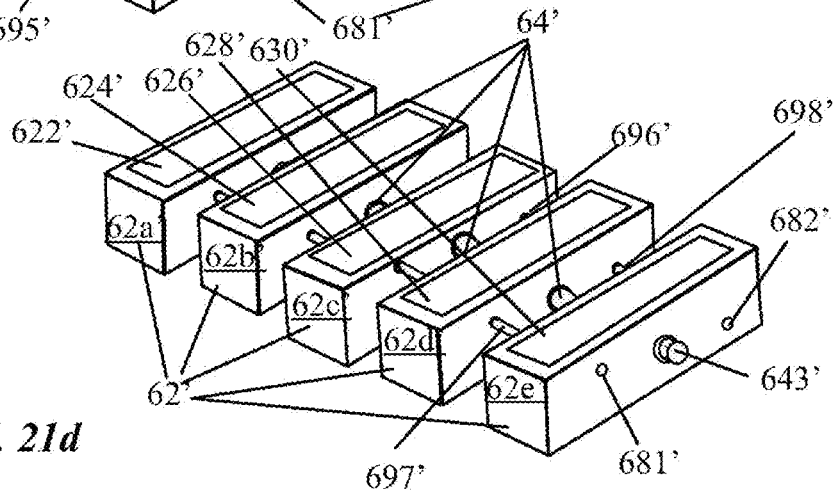
FIG. 21*d* is a block polygonal semi-rotatable multi-magazine manifold that has N blocks, where N is 5, and it would be supported by a strut assembly having N−1 struts, where N−1 struts is four.

FIG. 20 is a diagonal cross-section of the semi-rotatable multi-magazine manifold 60' without the quick connect axle 64' shown in FIG. 18. The center block **62*b*' has a centroid bearing bore 63*b*'. A center section of the axle 64', where the center section is the sectional length between slots 641' and 642' (as shown in FIG. 18) is substantially housed in the centroid bearing bore 63*b*'. The center block 62*b*' also has a pair of through-block openings 633' and 634' for the connecting rods 681' and 682'. The diameter of the opening 633' is sufficiently small to occlude the spacers 693', 694'. The right block 62*a* has a partial centroid end-bearing bore 63*a*' with a floor 64*a*', wherein a centroid partial bore 63*a*' can receive the spring 65' and an end of the axle 64'. The right block 62*a*' has threaded holes 631' and 632' the connecting rods 681' and 682' having threaded sections 671',672' (see FIG. 18). A left block 62*c*' has a centroid bore 63*c*' that narrows to a constricted bore 64*c*' that stops the axle but allows a button 643' (see FIG. 18) to project through and out the side of block 62*c*'. The axle 64' is largely centered in the centroid bearing bore. An exception is when pressure is applied to the button causing the compression spring 65' to be compressed, therein shifting the shaft toward the right block 62*a*, aligning the slots 641', 642' with the bearings slots 54*r*' and 541'. Without compression, the manifold is retained by the bearings 53*l*',53*r*'**.

To achieve the desired slope angle is **82*a* angle there are several factors to consider including the distance of the connecting rods from the axle, the proximity of the connecting rods to a block's face, the diameter of the spacers, and the location of the strut bearings. As shown in FIG. 18 and FIG. 19, the slope angle is relative shallow, and the bearings 53*l*1',53*r*' are substantially proximate to a lower side of the struts 52*l*', 52*r*'**.

The horizontal slide rail 330 and the horizontal slidable element 340 is shown in more detail in FIG. 22. In the embodiment the mounting block 310 is coextensive with the adapter. The horizontal slide rail 330 is fastened to the mounting block with at least two screws **15*a*, 15*b*. Only screw 15*a* is shown, as a portion of the mounting block is cutaway to see the horizontal slide rail 330**. In general, the slidable elements are not limited to a specific type of bearing to minimize friction, as multiple factors can enter in the determination. Encapsulated ball bearings and bushings are two types that are commonly employed. In the illustrated horizontal slidable element ball bears are shown, but bushings or self-lubricating systems can be employed.

The horizontal slide rail 330 has a pair of opposing channels, an upper channel **333*a* and a lower channel 333*b*. The horizontal slidable element 340 nominally has a set of race of ball bearings upper race 343*a* and lower race of ball bearings 343*b*. The upper race 343*a* is not visible because a portion of the horizontal slidable element 340 is cut away to show the first vertical slidable rail 30. The vertical slidable rail 30 is fastened to a rear side of the horizontal slidable element 340 using screws 345*b* and 345*a*. The top screw 345*a* is not visible as the upper portion of the horizontal slidable element 340 is cut-away. An upper portion of the vertical slidable rail 30 has a threaded hole 36*a* that receives the top screw 345*a* in an upper portion of the horizontal slidable element (not visible). The lower portion of the vertical slidable rail 30 is obscured by the horizontal slidable element 340, and so a threaded hole 36*b*** is not visible.

The first and second vertical slidable rails 30,230 also have a pair of opposing channels 33, 233. The first and second vertical slidable elements 40,240 have would similarly have their own set of race of ball bearings. The second vertical slidable element has a plurality of holes 243 for fastening the semi-rotatable strut assembly 50' (not shown).

Figure 23:
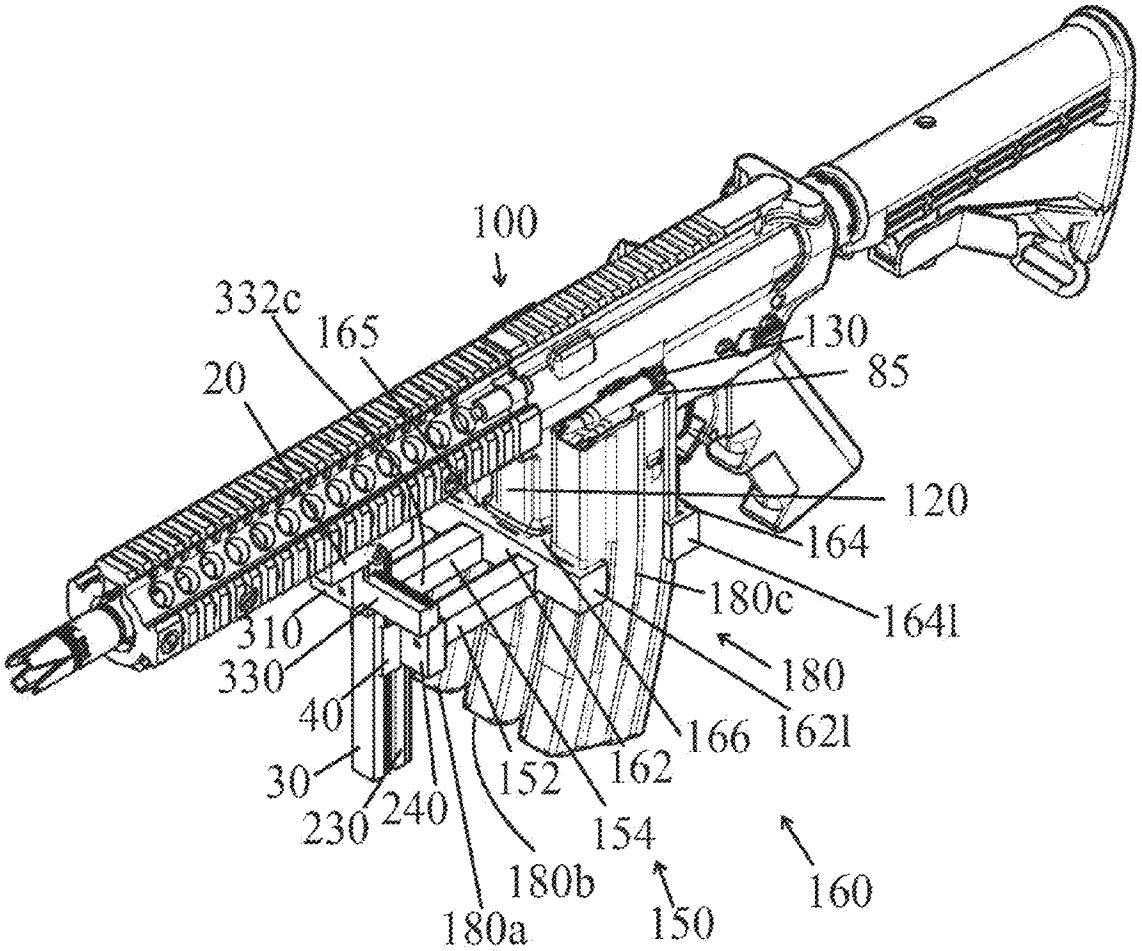
FIG. 23 is an elevated perspective view of an apparatus fitted on the firearm, wherein the apparatus has a z-plane horizontal slide rail, a horizontal slidable element that can be moved laterally from the illustrated center position, on which is mounted a first vertical slide rail having a first vertical slidable element and the first vertical slide has a piggy-backed second vertical slide rail with a second vertical slidable element on which is mounted a non-rotating strut assembly that supports a clamping multi-magazine manifold with a stack of magazines, wherein a center magazine of a laterally offset stack is shown loaded in the magazine-well.

An apparatus with a non-rotating strut assembly 150 and a non-rotatable multi-magazine manifold 160 is illustrated in FIG. 23. There are three higher round count magazines. Several rounds 85 are visible. A higher count magazine holds more than ten rounds, and usually twenty or more rounds. The non-rotating strut assembly 150 has a left prong 152 and right prong 154. The non-rotatable multi-magazine manifold 160 has a forward flat bar 162, a rearward flat bar 164, and spacing elements 165, 166 between the magazines. The forward clamp 162 is attached to the left prong 152 and right prong 154. The forward flat bar 162 has a pair of lateral tabs (only left tab **162*l* is shown), and the rearward flat bar 164 has a pair of lateral tabs, where only 164*l* is visible. The width of the spacing elements 165, 166 matches distance between stopping points 331*a*,331*b*,331*c* (not visible in this view-see FIG. 18*b* and FIG. 22). As shown there is a center magazine 180*b*, a left magazine 180*c*, and a right magazine 180*a*. The magazines form a stack 180. As previously disclosed the apparatus has a horizontal slide rail 330 with a first horizontal slidable element 340 that provides the capability to shift the non-rotatable multi-magazine manifold 160 to another stopping point, when the vertical assembly is lowered. The first horizontal slide rail 330 is attached to the adapter 20 via the mounting block 310. The first vertical slide rail 30 with a piggy-backed second vertical slide rail 230 via a first vertical slidable element 40. The second vertical slidable element 240 has rearward facing plate to which is mounted the non-rotating strut assembly 150. A magazine is selected by moving to a stopping point. Magazine 180*b* is shown loaded in the firearm's magazine-well 120**.

Figure 24:
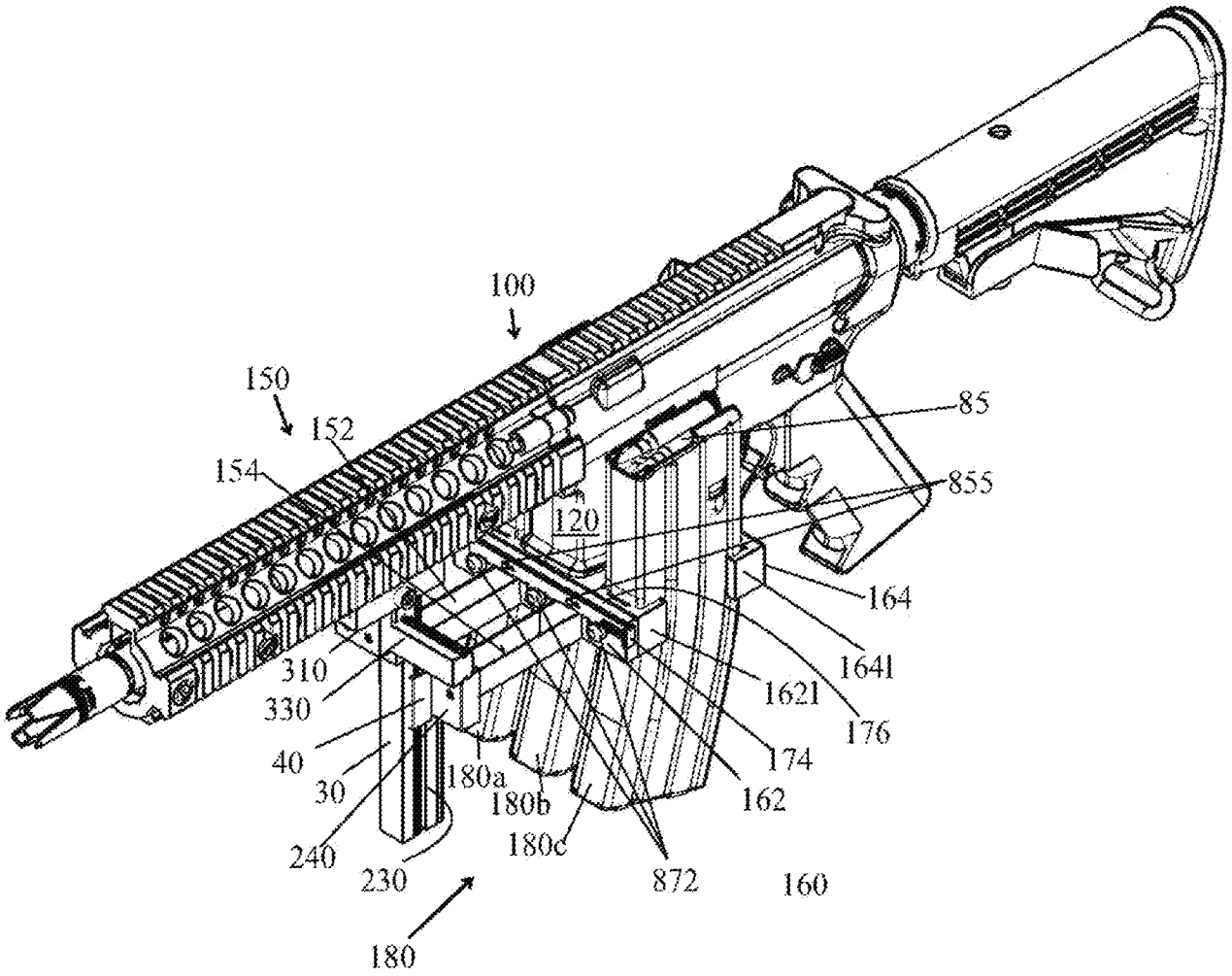
FIG. 24 is an elevated perspective view of the apparatus illustrated in FIG. 23, wherein the apparatus has a quick release slide lock (QRSL) that enables attaching and detaching a modified clamping multi-magazine manifold for holding a stack of magazines.

The apparatus as illustrated in FIG. 24 has a quick release slide lock (QRSL) 800 that enables attaching and detaching a modified non-rotatable multi-magazine manifold 168, where components of the QRSL 800 are fitted on the non-rotating strut assembly 150 and the non-rotatable multi-magazine manifold 160 that provide for changing manifolds. The modified forward flat bar 162 of the non-rotatable multi-magazine manifold is fitted with a plurality of studs 872 that project forward. Three studs are shown, and each has a beveled end and a setback circular groove. A spring loaded sliding plate 835 forwardly overlaps a latch base plate 825. The spring loaded sliding plate 835 (see FIG. 26*b*) has a plurality of elongate holes and each hole has a headed stem 855 that is projecting from the latch base plate 825. The spring loaded sliding plate 835 has a plurality of semi-circular edges, and the semi-circular edges are abutting the setback circular grooves of the studs 872, therein latching the non-rotatable multi-magazine manifold 160 to the non-rotating strut assembly 150.

Figure 25:
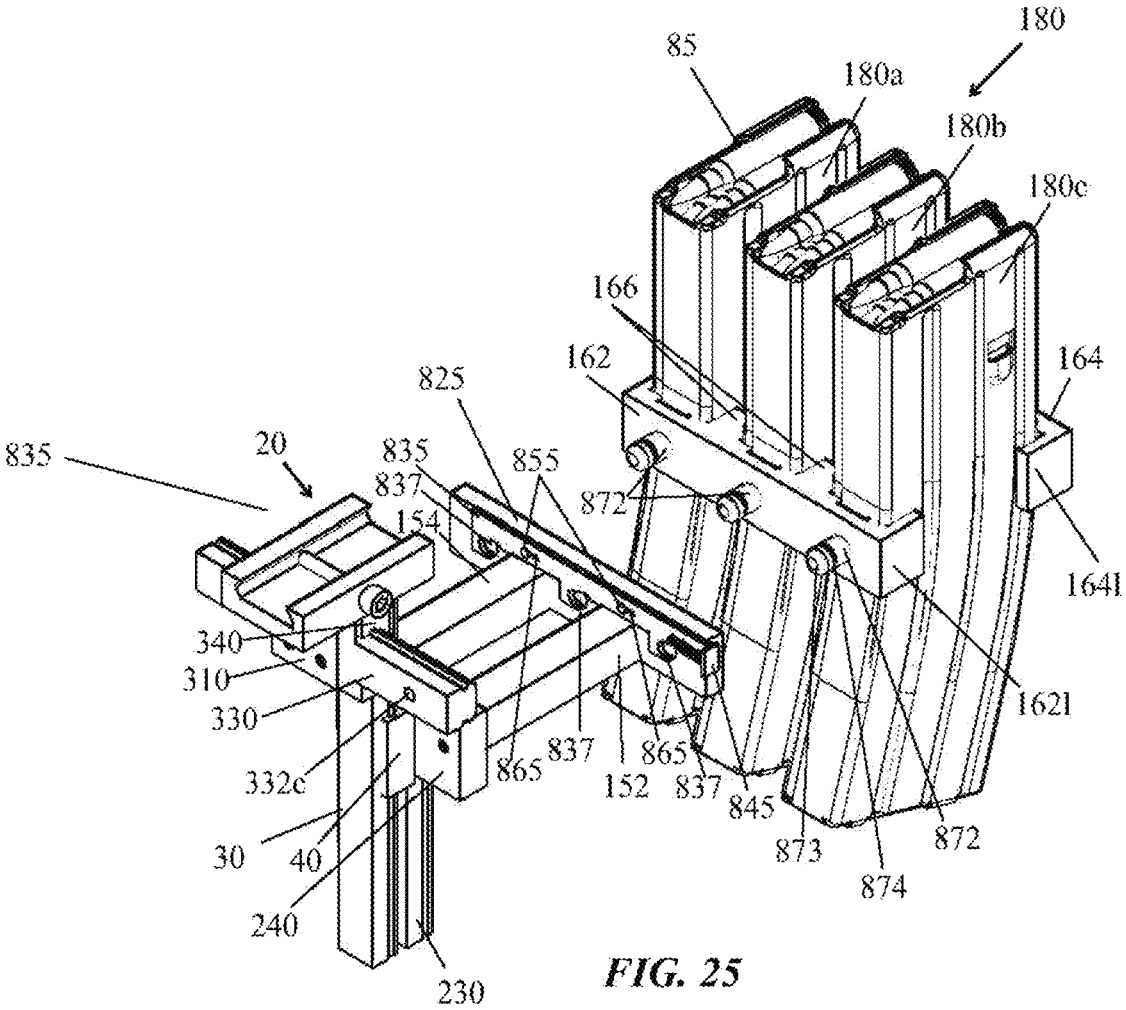
FIG. 25 is an elevated perspective view of the apparatus illustrated in FIG. 24, wherein the modified clamping multi-magazine manifold is disconnected from the strut assembly fitted with the quick release slide lock (QRSL)

In FIG. 25 the modified non-rotatable multi-magazine manifold 168 is disconnected from the strut assembly fitted with the quick release slide lock 800. A little more detail is viewable. The beveled studs 872, mounted on the forward clamp bar 162 of the non-rotatable multi-magazine manifold, have a relatively high aspect of bevel 873, so that they are capable generating a lateral penetrating force, enough force to widen an iris-like opening. The circular groove 874 is substantially at the perimeter of the bevel 873. The lock 800 is in the default locked position, with openings 837 partially closed, a QRSL button 845 on the spring loaded sliding plate 835 shifted outboard, where it is pushed inboard to open the lock. The a set of headed stems 855 are inboard of a set of two elongate holes (see FIG. 26*a*), limiting a distance that the spring loaded sliding plate 835 can move outboard, therein controlling a diameter of the partially closed openings 837.

Figures 26A, 26B:
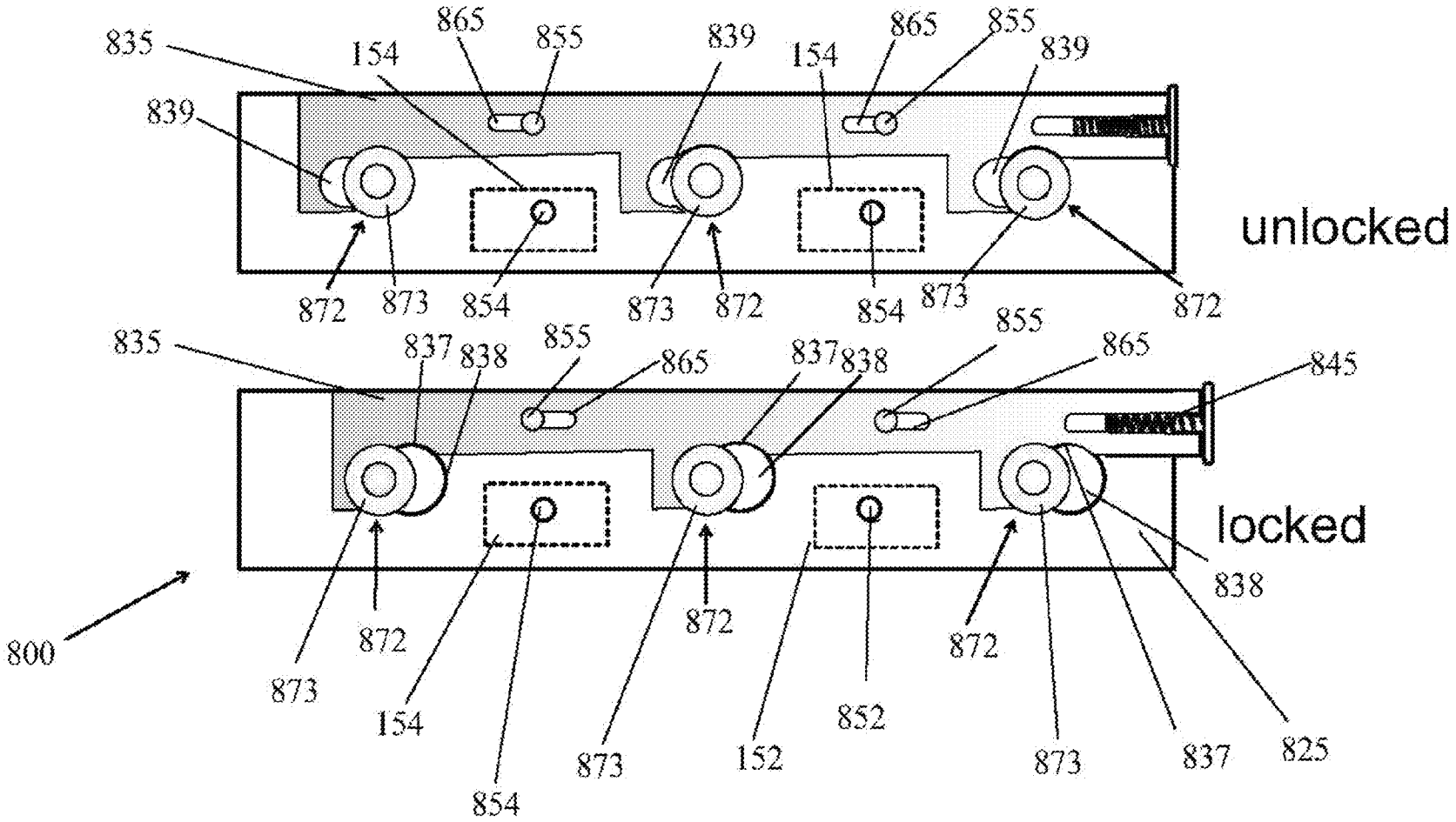
FIG. 26*a* is a planar view of the quick connection-release mechanism that is a quick release slide lock (QRSL), where the QRSL is in the locked position, which is the default position, wherein a forward bar element on a modified clamping multi-magazine manifold has two or more studs that project toward the QRSL attached to the strut assembly, where each stud has a circular groove (see FIG. 25) that is proximate to an end of the stud, wherein an end of each stud is beveled, and the stud is long enough to extend through the QRSL, which has a spring loaded sliding plate that overlaps and a prong mounted base plate having a set of larger diameter holes, wherein the spring loaded sliding plate has a lower edge that includes a set of smaller diameter semi-circular and larger diameter semi-circular edge components that intersect the studs, wherein taken together the circular edge components of the sliding plate and the set of larger diameter holes of base plate intersect the circular groove locking the stud, and when locked a QRSL button on the spring loaded sliding plate is shifted outboard.
FIG. 26*b* is a planar view of the quick release slide lock (QRSL), where the QRSL is in the unlocked—release position, which is produced when the QRSL button is pressed causing the spring loaded sliding plate to move inboard, wherein each of the studs can be disengaged, passing past the set of larger diameter circular edge components, therein enabling the studs on the modified clamping multi-magazine manifold to be removed.

A closer view of the quick release slide lock 800 is shown in FIG. 26*a*. The QRSL is in the locked position, which is the default position, wherein three beveled studs 872 are projecting through the QRSL, where each stud 872 has a circular groove 874 (see FIG. 25) that is proximate to the perimeter of the bevel 873, and each stud is long enough to extend through the QRSL, which has the spring loaded sliding plate 835 that forwardly overlaps the latch base plate 825 which has a set of larger diameter holes 838. The spring loaded sliding plate has a lower edge that includes a curvilinear section of a smaller diameter semi-circular segment 839 contiguous with a larger diameter semi-circular segment 837, which, when moved laterally outboard, the curvilinear section intersects a stud 872, and more particularly the circular groove 874 proximate to the perimeter of the bevel 873. Taken together the curvilinear sections of the sliding plate and the larger diameter holes 838 of the latch base plate lock the stud. The prongs 154,152 are shown is ghost by the dashed lines. Fastening holes 854 are for attaching the latch base plate 825 to the prongs 154,152.

The quick release slide lock (QRSL) is shown unlocked in FIG. 26*b*. The unlocked—release position is produced when the QRSL button 845 is pressed, causing the spring loaded sliding plate to move inboard, wherein each of the studs 872 will be disengaged, therein enabling the modified non-rotating multi-magazine manifold to be removed.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An apparatus for repeatedly aligning and loading ammunition into a firearm having a magazine-well and a magazine ejection device, said apparatus comprising:

an adapter mounted onto a handguard of the firearm forward of the magazine-well, the adapter comprised of a beam and a set of fastening elements, wherein the adapter provides a platform that won't slip relative to the firearm while the firearm is being fired;

a vertical slide rail, which is a rigid structural member, comprised of an end that is mounted to the adapter and an opposing end that is terminated with a full-stop element, wherein the vertical slide rail functions as a guiding track to which a carriage can be secured;

a vertical slidable element that is supported and guided by the vertical slide rail, wherein the vertical slidable element functions as the carriage to move a long the vertical slide rail even when the vertical slidable element is under stress, wherein the vertical slidable element has a mountable surface that when the apparatus is mounted on the firearm, the mountable surface of the vertical slidable element faces rearward toward the magazine-well;

a rotatable multi-magazine manifold comprised of a polygon having an axial center and a plurality of perimeter walls, wherein each of the perimeter walls has an external mounting face, each mounting face can receive and hold a magazine by a base portion of the magazine in alignment with the magazine-well, and when the rotatable multi-magazine manifold is filled the magazines are in radial alignment with the axial center;

a rotatable strut assembly that is fastened to the mountable surface of the vertical slidable element, wherein the rotatable strut assembly is comprised of a rearward projecting strut that is co-extensive to the axial center of the rotatable multi-magazine manifold, and a plurality of set points that correspond to positions where each of the magazines on the rotatable multi-magazine manifold will be aligned with the magazine-well as the manifold is incremental rotated;

wherein, when the magazine ejection device is actuated, a current magazine in the well is ejected causing the manifold, the rotatable strut assembly, and the vertical slidable element to drop to their lowest position, wherein the rotatable multi-magazine manifold can be turned to a next set point for a next magazine, and the next magazine is now positioned beneath and in-line with an empty magazine-well, wherein the next magazine can be shoved into the empty magazine-well, by raising the rotatable multi-magazine manifold, therein resetting the rotatable strut assembly and the first vertical slidable element to an upper operational position; and wherein repeatedly aligning and loading of the firearm is accomplished without the need to visually disengage from a target.

2. The apparatus according to claim 1, wherein the rotatable multi-magazine manifold has a physical shape that is predominately a polygonal frustum having a rearward wall, a forward wall and a set of three to six perimeter walls, wherein, operationally, the axial center of the rotatable multi-magazine manifold is an axial center of the polygonal frustum, and the axial center of the polygonal frustum is co-extensive with the rotatable strut assembly, wherein the rearward wall is spatially rearward and below the magazine well and the forward wall is spatially forward of the magazine well.

3. The apparatus according to claim 2, wherein on each perimeter wall of the polygonal frustum there can be mounted one magazine that is positioned in alignment with the magazine-well when the manifold is advanced to a next magazine, wherein all of the mounted magazines are about perpendicular to the axial center of the rotatable multi-magazine manifold and radially distributed.

4. An apparatus for repeatedly aligning and loading ammunition into a magazine-well of a firearm having a magazine ejection device, said apparatus comprising:

an adapter comprised of a beam and a set of fastening elements, wherein the adapter provides a platform that won't slip relative to the firearm while being fired, wherein the adapter is mounted onto a handguard of the firearm forward of the magazine-well;

a first vertical slide rail, which is a rigid structural member, wherein an end of the first vertical slide rail is mounted on the adapter perpendicular to the beam, and an opposing end is terminated with a full-stop element, wherein the first vertical slide rail has a guiding track to which a carriage can be secured;

a first vertical slidable element that is supported and guided by the first vertical slide rail, wherein the first vertical slidable element functions as the carriage having a first resistance to move along the first vertical slide rail even when the first vertical slidable element is under stress, wherein the first vertical slidable element has a mountable surface that, when the apparatus is mounted, faces rearward toward the magazine-well;

a second vertical slide rail, which is a rigid structural member, wherein an end of the second vertical slide rail is mounted on the first vertical slidable element with a partial overlap of the first vertical slide rail, wherein the second vertical slide rail functions as a retractable extension of the first vertical slide rail;

a second vertical slidable element that is supported and guided by the second vertical slide rail, where its vertical position on the second vertical slide rail can change, either moving downward when the magazine ejection device is actuated to eject a current magazine from the magazine-well or moving upward when a next magazine is shoved into the magazine-well, wherein the second vertical slidable element has an adjustable resistance element that is set to a second resistance that is higher than the first resistance, therein preventing the second vertical slidable element from moving as fast as the first vertical slidable element therein ensuring that rotation commences only after an ejected magazine has cleared a rim of the magazine-well, wherein the second vertical slidable element has a mounting plate that, when the apparatus is mounted, faces rearward toward the magazine-well;

a rotatable multi-magazine manifold comprised of a polygon having an axial center and having a set of perimeter walls, wherein each of the perimeter walls has an external mounting face, wherein each external mounting face can receive and hold a magazine by a base portion of the magazine in potential alignment with the magazine-well, and when the rotatable multi-magazine manifold is filled, all of the magazines are in radial alignment with the axial center;

a rotatable strut assembly comprised of a plurality of set points, a rearward projecting strut that is nominally connected to the axial center of the rotatable multi-magazine manifold, wherein operationally the rotatable multi-magazine manifold is fitted with a plurality of magazines, wherein the rearward projecting strut has a length selected to front-to-back spatially align each magazine under the magazine-well, and wherein a set point for each of the perimeter walls is selected to side-to-side spatially align each magazine under the magazine-well;

wherein when the magazine ejection device is actuated, the magazine in the magazine-well is ejected causing the rotatable multi-magazine manifold to drop, which in turn causes the rotatable strut assembly, the first vertical slidable element and the second vertical slide rail, and the second slidable element to all drop to a lowered position, wherein the rotatable multi-magazine manifold is clear of a rim of the magazine-well and can be turned to a next set point for a next magazine, where the next magazine is positioned beneath and in-line with an empty magazine-well, wherein the next magazine can be shoved into the empty magazine-well, by raising the rotatable multi-magazine manifold, the rotatable strut assembly, the second vertical slidable element, the second vertical slide rail, and the first vertical slidable element to an upper operational position.

5. The apparatus according to claim 4, wherein the rotatable multi-magazine manifold has a physical shape that is predominately a polygonal frustum having a rearward wall, a forward wall and a set of three to six perimeter walls, wherein, operationally, the axial center of the rotatable multi-magazine manifold is the axial center of the polygonal frustum, and the axial center of the polygonal frustum is co-extensive with the rotatable strut assembly, wherein the rearward wall is spatially rearward and below the magazine well and the forward wall is spatially forward of the magazine well.

6. The apparatus according to claim 5, wherein on each perimeter wall of the polygonal frustum there can be mounted one magazine that is positioned in alignment with the magazine-well as the rotatable multi-magazine manifold is rotated, wherein all of the mounted magazines are about perpendicular to the axial center of the rotatable multi-magazine manifold and radially distributed.

7. The apparatus according to claim 4 further comprised of a slidable grip assembly, wherein the slidable grip assembly comprises:

a rod mounted about orthogonal to the adapter, wherein the rod provides support for the slidable grip assembly, wherein the rod extends downward from a forward location on the adapter;

a hand grip with an core grip slidable element, wherein the hand grip can axially slide over the rod;

a slidable brace comprising an L shaped bar having a horizontal section with a forward opening through which passes the rod and a rearward opening through which can pass the first vertical slide rail and the first vertical slidable element, and a vertical section that overlaps the second vertical slide rail and is attached to the second vertical slidable element, wherein the core grip element of the hand grip is coaxially slidable on the rod and perpendicularly attached to an underside of the horizontal section coaxial with the forward opening, therein making the slidable brace slidable on the rod;

wherein, when the magazine ejection device is actuated, the magazine in the magazine-well is ejected causing the rotatable multi-magazine manifold to drop, the slidable brace with the attached hand grip and the attached second vertical slidable element drops to the lowered position; and wherein, when the next magazine is shoved into the empty magazine-well, raising the rotatable multi-magazine manifold, the slidable brace with the attached hand grip and the attached second vertical slidable element are raised to their upper operational position.

8. The apparatus according to claim 7 further comprises:

an automatic rotation mechanism that advances the rotatable multi-magazine manifold to the next magazine, wherein the automatic rotation mechanism harvests energy released when the magazine is ejected to rotate to the next magazine, wherein an advance in rotation is measured in a number of degrees of rotation, wherein the number of degrees of rotation is equal to 360 degrees divided by a total number of magazine mounting faces.

9. The apparatus according to claim 8, wherein said automatic rotation mechanism further comprises:

a geared cocking round lever having a set of scalloped gears mounted on the mounting plate of the second vertical slidable element, wherein the geared cocking round lever has an axial connection with the rotatable multi-magazine manifold;

a spring loaded latch having a number of positively scalloped gears, wherein the number is two to seven, and is mounted proximate to a terminal end of the second vertical slide rail, wherein at a start position, a coil spring is weakly tensioned and the spring loaded latch is about vertical, stopped by a protruding latch start notch that is abutting a peg projecting from the second vertical slide rail;

wherein as the geared cocking round lever slides downward the scalloped gears encounter a first number of positively scalloped gears on the spring loaded latch, and upon meshing the geared cocking round lever is tangentially pushed, incrementally turning clockwise, and the spring loaded latch pivots counterclockwise exposing at one more of the number of positively scalloped gears, which intermesh with another portion of the set of scalloped gears on the geared cocking round lever, therein tightening the coil spring, wherein movement continues until the spring loaded latch has no additional gears and is limited by a latch stop notch resting against the peg, whereupon transverse and rotational movement ceases and the rotatable multi-magazine manifold has been turned a desired number of degrees of rotation; and wherein, when the second vertical slidable element is raised, the set of scalloped gears on the geared cocking round lever slip past the number of positively scalloped gears on the spring loaded latch, and there is no additional rotation, and the tightened coiled spring unwinds returning the spring loaded latch to the start position.

* * * * *